US007603878B2

(12) United States Patent
Fyvie

(10) Patent No.: US 7,603,878 B2
(45) Date of Patent: Oct. 20, 2009

(54) SYSTEM AND METHOD FOR IMPROVED SOLVENT RECOVERY IN A DRY CLEANING DEVICE

(75) Inventor: Thomas Joseph Fyvie, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 645 days.

(21) Appl. No.: 11/263,164

(22) Filed: Oct. 31, 2005

(65) Prior Publication Data

US 2006/0059632 A1 Mar. 23, 2006

Related U.S. Application Data

(63) Continuation-in-part of application No. 10/330,734, filed on Dec. 30, 2002, now Pat. No. 7,210,182, which is a continuation-in-part of application No. 10/127,001, filed on Apr. 22, 2002, now Pat. No. 7,308,808.

(51) Int. Cl.
*D06B 5/10* (2006.01)

(52) U.S. Cl. ..... 68/18 R; 68/20

(58) Field of Classification Search ..... 68/18 R, 68/18 C, 18 F

See application file for complete search history.

(56) References Cited

U.S. PATENT DOCUMENTS 1,775,699 A * 9/1930 Silver ..... 8/142
1,776,190 A 9/1930 Mishaw
1,909,384 A * 5/1933 White ..... 68/18 C
2,000,137 A * 5/1935 Kelley ..... 210/777
2,019,011 A 10/1935 Johnson
2,114,776 A 4/1938 Davis
2,146,262 A 2/1939 Johnson
2,656,696 A * 10/1953 McDonald ..... 68/18 R
2,777,534 A 1/1957 McDonald
2,932,961 A * 4/1960 Robbins et al. ..... 68/4
3,065,617 A 11/1962 Fuhring (Continued)

FOREIGN PATENT DOCUMENTS

DE 38 31 722 * 3/1990

(Continued)

OTHER PUBLICATIONS

WO093/01345 Jan. 1993 (Onodera).

(Continued)

*Primary Examiner*—Frankie L Stinson
(74) *Attorney, Agent, or Firm*—Paul J. DiConza

(57) ABSTRACT

System and method for improved solvent recovery in a dry cleaning device includes a washer drum, a cleaning basket disposed in the washer drum and configured to receive articles and a solvent based cleaning fluid, a working tank configured to receive the solvent based cleaning fluid used in the washer drum and cleaning basket, an air management mechanism configured to drain cleaning fluid condensate produced from the washer drum and cleaning basket directly into the working tank, and a low mixing pump configured to pump the solvent based cleaning fluid from the cleaning basket to the working tank, the low mixing pump characterized by a Reynolds number of about 15,000 or less, wherein the Reynolds number is determined as a function of one or more properties associated with an impeller of the low mixing pump.

12 Claims, 20 Drawing Sheets

U.S. PATENT DOCUMENTS

| | | | | | |
|---|---|---|---|---|---|
| 3,203,208 | A | | 8/1965 | Brucken | |
| 3,246,493 | A | * | 4/1966 | Oles | 68/18 R |
| 3,269,155 | A | * | 8/1966 | Shaw | 68/18 R |
| 3,327,856 | A | | 6/1967 | Beduhn | |
| 3,497,452 | A | | 2/1970 | Arvanitakis | |
| 3,583,181 | A | | 6/1971 | Brillet | |
| 3,583,567 | A | | 6/1971 | Maestrelli | |
| 3,613,135 | A | | 10/1971 | Fuhring et al. | |
| 3,840,340 | A | | 10/1974 | McKnight | |
| 3,931,011 | A | | 1/1976 | Richards et al. | |
| 4,074,984 | A | | 2/1978 | Fuhring | |
| 4,115,061 | A | | 9/1978 | Grunewalder | |
| 4,138,337 | A | | 2/1979 | Smith | |
| D253,422 | S | | 11/1979 | Smith | |
| 4,279,704 | A | | 7/1981 | Noble, Sr. et al. | |
| 4,283,279 | A | | 8/1981 | Smith | |
| 4,298,465 | A | | 11/1981 | Druffel | |
| 4,444,625 | A | | 4/1984 | Smith | |
| 4,456,529 | A | | 6/1984 | Shinaver | |
| 4,513,590 | A | | 4/1985 | Fine | |
| 4,661,612 | A | | 4/1987 | George et al. | |
| 4,685,930 | A | | 8/1987 | Kasprzak | |
| 4,774,346 | A | | 9/1988 | Imai et al. | |
| 4,781,041 | A | * | 11/1988 | Fowler | 68/18 F |
| 4,813,247 | A | | 3/1989 | Takeda | |
| 4,938,845 | A | | 7/1990 | Kohler | |
| 5,047,123 | A | * | 9/1991 | Arvanitakis | 202/170 |
| 5,069,755 | A | | 12/1991 | Durr et al. | |
| 5,112,192 | A | * | 5/1992 | Weetman | 416/201 A |
| 5,225,509 | A | | 7/1993 | Heinrich et al. | |
| 5,236,580 | A | | 8/1993 | Kelleher | |
| 5,238,899 | A | | 8/1993 | Kadowaki et al. | |
| 5,245,067 | A | | 9/1993 | Schneider et al. | |
| 5,288,831 | A | | 2/1994 | Ichinohe et al. | |
| 5,348,588 | A | | 9/1994 | Winston | |
| 5,520,028 | A | | 5/1996 | Kim et al. | |
| 5,649,372 | A | | 7/1997 | Souza | |
| 5,783,078 | A | | 7/1998 | Roll et al. | |
| 5,860,796 | A | | 1/1999 | Clausen | |
| 5,876,461 | A | | 3/1999 | Racette et al. | |
| 5,940,988 | A | | 8/1999 | Eisen | |
| 5,948,441 | A | | 9/1999 | Lenk et al. | |
| 5,997,739 | A | | 12/1999 | Clausen et al. | |
| 6,042,617 | A | | 3/2000 | Berndt | |
| 6,042,618 | A | | 3/2000 | Berndt et al. | |
| 6,056,789 | A | | 5/2000 | Berndt et al. | |
| 6,059,845 | A | | 5/2000 | Berndt et al. | |
| 6,063,135 | A | | 5/2000 | Berndt et al. | |
| 6,086,635 | A | | 7/2000 | Berndt et al. | |
| 6,203,698 | B1 | | 3/2001 | Goodrich | |
| 6,536,059 | B2 | | 3/2003 | McClain et al. | |
| 6,691,536 | B2 | | 2/2004 | Severns et al. | |
| 6,904,703 | B2 | * | 6/2005 | Naganawa et al. | 34/596 |
| 7,094,016 | B1 | * | 8/2006 | Zaher | 415/1 |
| 7,226,277 | B2 | * | 6/2007 | Dooley | 417/356 |
| 2002/0073491 | A1 | | 6/2002 | Mettlach et al. | |
| 2005/0091758 | A1 | * | 5/2005 | Sawa | 8/142 |

FOREIGN PATENT DOCUMENTS

| | | | | |
|---|---|---|---|---|
| EP | 0 543665 | A1 | | 5/1993 |
| JP | 2-57296 | | | 2/1990 |
| JP | 3-237999 | | | 10/1991 |
| JP | 4-141196 | | | 5/1992 |
| JP | 04-141196 | | * | 5/1992 |
| JP | 04-210094 | | * | 7/1992 |
| JP | 05-038394 | | * | 2/1993 |
| JP | 5-192492 | | | 8/1993 |
| JP | 06-238095 | | * | 8/1994 |
| JP | 10-272289 | | | 10/1998 |
| JP | 11-57328 | | | 3/1999 |
| JP | 11-150896 | | * | 6/1999 |

OTHER PUBLICATIONS

"Dahl Fuel Filter Water Separator," Pecuniary, Inc. (www.diesel-fuels.com), 10 pages.

"Turbine Series Fuel Filter/Water Separators," Mid-Atlantic Engine Supply Corp. (www.maesco.com), 11 pages.

* cited by examiner

*Fig.* 17

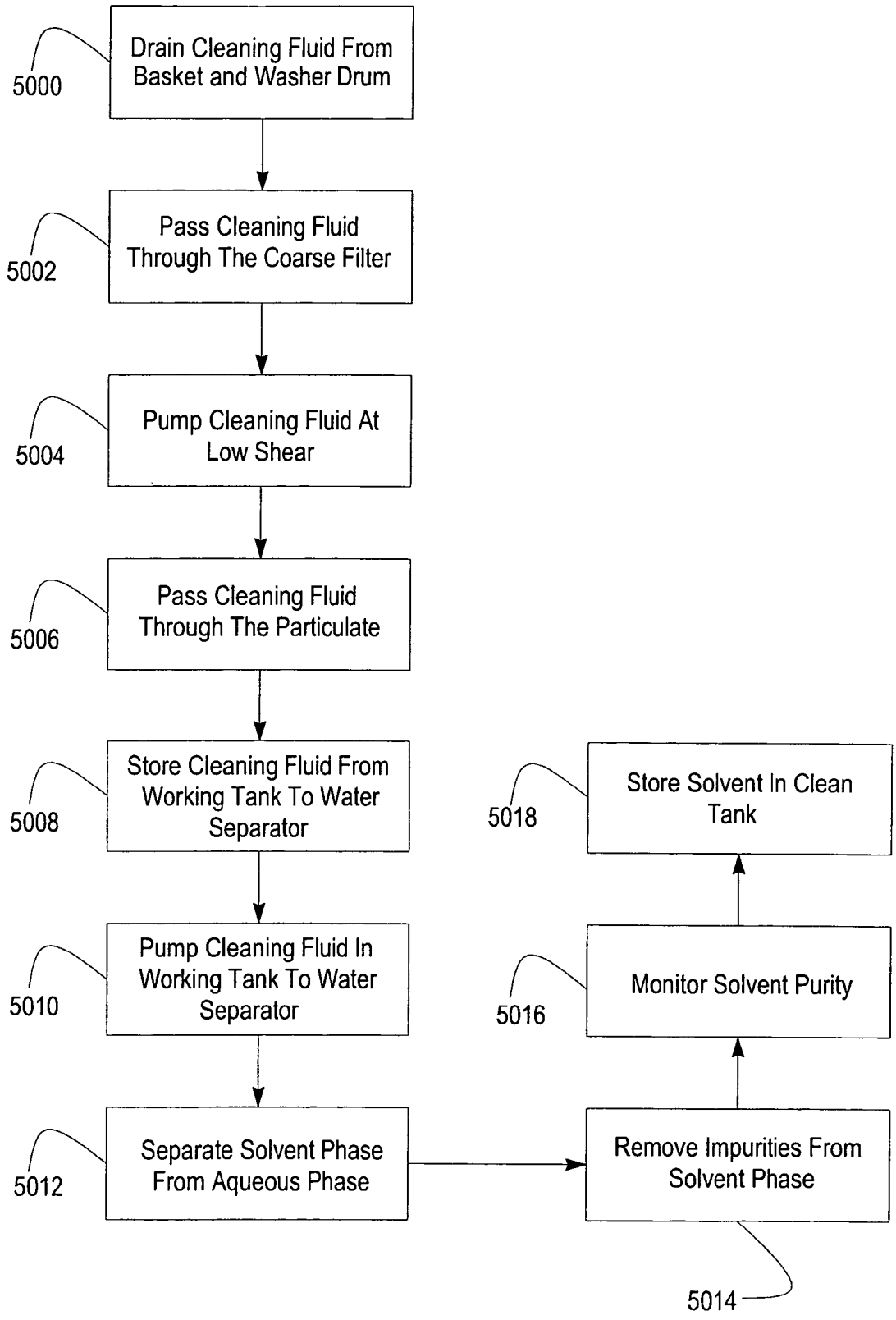
*Fig.* 20

SYSTEM AND METHOD FOR IMPROVED SOLVENT RECOVERY IN A DRY CLEANING DEVICE

CROSS REFERENCE TO RELATED APPLICATIONS

This patent application is a continuation-in-part and commonly assigned U.S. patent application Ser. No. 10/330,734 entitled "System And Method For Solvent Recovery And Purification In A Low Water Or Waterless Wash", filed Dec. 30, 2002 now U.S. Pat. No. 7,210,182, which in turn is a continuation-in-part patent application and commonly assigned U.S. patent application Ser. No. 10/127,001 entitled "Apparatus And Method For Article Cleaning", filed Apr. 22, 2002 now U.S. Pat. No. 7,308,808.

BACKGROUND

Embodiments of the present invention relate generally to dry cleaning or solvent cleaning and more particularly to solvent separation and recovery.

The process of cleaning articles with the use of solvents (also referred to as "dry cleaning") is a well established commercial industry. Many commercial dry cleaning apparatuses incorporate a solvent recycling mechanism which enables extended use of the solvents while reducing unnecessary operator exposure to solvents. Sometimes during the dry cleaning process, the dry cleaning solvents may become mixed with small amounts of water remaining in the articles or dry cleaning machine to form an solvent phase. Before the solvent may be reused however, it is often desirable to separate and remove the water from the solvent. Failure to separate and remove water from the solvent can result in a contaminated aqueous phase that leads to bacterial growth and subsequent odor.

Typical commercial dry cleaning machines use distillation to reclaim solvent (e.g., perchloroethylene, cyclic siloxane) by first heating the solvent to the temperature at which it produces vapors. A heat exchanger collects the vapors, separates the water phase and condenses the vapors into a clean, purified solvent ready for reuse, while the impurities are concentrated in the distillate for disposal. Unfortunately, conventional distillation approaches are not practical or cost effective for dry cleaning in environments other than large commercial installations.

Although some home-based dry cleaning systems have been proposed, such systems typically only employ adsorption filters such as a carbon adsorption filter to remove impurities during a solvent recovery process. Although these adsorption filters may work well to remove some particulate matter from the aqueous phase of the solvent, they are typically not equipped to separate and remove water. Furthermore, the removal of water from the aqueous phase of the solvent can take a long time thereby increasing the necessary wash cycle time.

BRIEF DESCRIPTION OF THE DISCLOSURE

In accordance with one embodiment of the invention, a system for improved solvent recovery in a dry cleaning device includes a washer drum and a cleaning basket disposed in the washer drum that is configured to receive articles and a cleaning fluid. The system further includes a working tank configured to receive the cleaning fluid used in the washer drum and cleaning basket, as well as an air management mechanism configured to drain cleaning fluid condensate produced from the washer drum and cleaning basket directly into the working tank. Additionally, the system includes a low mixing pump configured to pump the cleaning fluid from the cleaning basket to the working tank. The low mixing pump may be characterized by a Reynolds number of about 15,000 or less, where the Reynolds number is determined as a function of one or more properties associated with an impeller of the low mixing pump.

In accordance with another embodiment of the present invention the system for improved solvent recovery in a dry cleaning device may further include a fluid process pump configured to pump the cleaning fluid from the working tank, and a fluid separator configured to receive the cleaning fluid from the fluid process pump and substantially separate an aqueous phase from the cleaning fluid.

In accordance with one embodiment of the invention, a method for improved solvent recovery in a dry cleaning device involves recovering and purifying a cleaning fluid used to clean articles in the dry cleaning device having a washer drum, a cleaning basket disposed in the washer drum, and a working tank configured to receive used cleaning fluid. The method includes removing the cleaning fluid used in the washer drum and cleaning basket and pumping the removed cleaning fluid into the working tank at a low operating speed to reduce mixing of liquid phases of the cleaning fluid. In one embodiment, the cleaning fluid is pumped using a low mixing pump characterized by a Reynolds number of about 15,000 or less, wherein the Reynolds number is determined as a function of one or more properties associated with an impeller of the low mixing pump. Additionally, the method includes draining cleaning fluid condensate produced from the washer drum and cleaning basket directly into the working tank.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 20 illustrates an exemplary process flow for performing recovery and purification of dirty solvent using the elements shown in FIG. 19.

DETAILED DESCRIPTION

Embodiments of the present invention include a system and method for improved solvent recovery in a non-commercial dry cleaning device. As used herein, the term, "articles" is defined, for illustrative purposes and without limitation, as fabrics, textiles, garments, and linens and any combination thereof. As used herein, the term, "solvent based cleaning fluid" is defined for illustrative purposes and without limitation, as comprising a cyclic siloxane solvent such as decamethylcyclopentasiloxane (D5) and, optionally, a cleaning agent. In one embodiment, if water is present in a solvent based cleaning fluid, the water may be present in an amount in a range from about 1 percent to about 8 percent of the total weight of the solvent based cleaning fluid. In another embodiment, if water is present in the solvent based cleaning fluid, the water may be present in an amount in a range from about 1 percent to about 2 percent of the total weight of the solvent based cleaning fluid. As used herein, the term, "cleaning agent" is defined for illustrative purposes and without limitation, as being selected from the group consisting of sanitizing agents, emulsifiers, surfactants, detergents, bleaches, softeners, and combinations thereof. As used herein, the term, "water based cleaning fluid" is defined for illustrative purposes and without limitation, as comprising water and, optionally, a cleaning agent.

Figure 1:
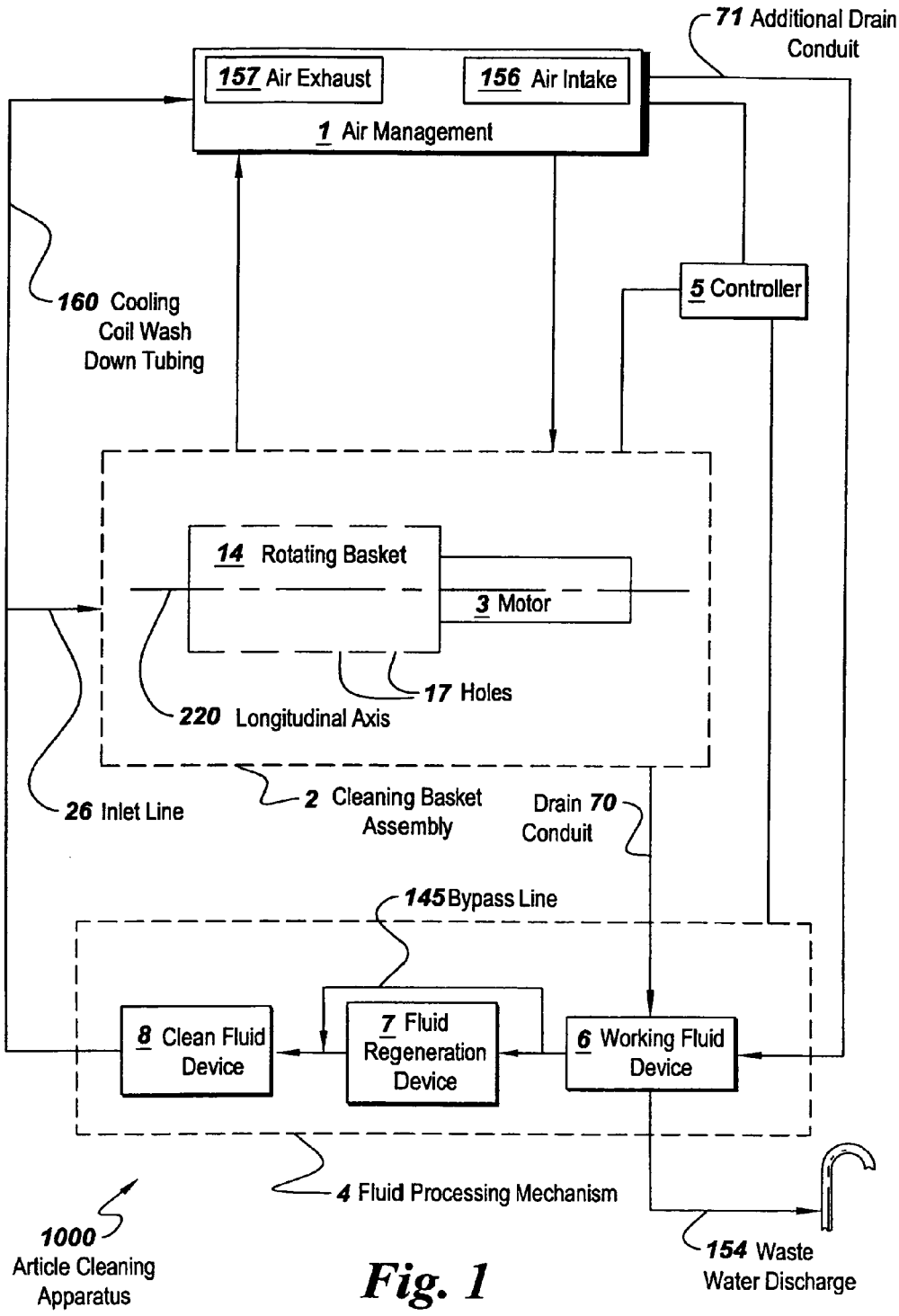
FIG. 1 is a block diagram of the article cleaning apparatus in accordance with one embodiment of the present invention.

FIG. 1 illustrates an article cleaning apparatus in accordance with one embodiment of the present invention. In one embodiment, the article cleaning apparatus 1000 of FIG. 1 is configured to perform a cleaning process 350 illustrated in FIG. 11. As used herein, the term, "cleaning process" is defined, for illustrative purposes and without limitation, as utilizing a solvent cleaning process 375, a water cleaning process 600, and any combination thereof. The solvent cleaning process 375 and the water cleaning process 600 are presented in more detail after the description of the article cleaning apparatus 1000 of FIG. 1.

Referring to FIG. 1, the article cleaning apparatus 1000 comprises the air management mechanism 1, the cleaning basket assembly 2, and a fluid processing mechanism 4. The fluid processing mechanism 4 further comprises a working fluid device 6, a fluid regeneration device 7, and a clean fluid device 8. As illustrated in FIG. 1, the working fluid device 6 may be coupled to the fluid regeneration device 7, the cleaning basket assembly 2, and the air management mechanism 1. Further, the clean fluid device 8 may be coupled to the cleaning basket assembly 2, the air management mechanism 1, and the fluid regeneration device 7. In the illustrated embodiment, the article cleaning apparatus 1000 further comprises a controller 5 which may be coupled to the air management mechanism 1, the cleaning basket assembly 2, the working fluid device 6, the regeneration device 7, and the clean fluid device 8 as shown. In one embodiment, the controller 5 is configured to further facilitate performance of the cleaning process 350 by the article cleaning apparatus 1000.

In the illustrated embodiment of FIG. 1, the cleaning basket assembly 2 may comprise a rotating basket 14 disposed in a washer drum (not shown in FIG. 1) for receiving articles. An annulus (also not shown in FIG. 1) may separate the rotating basket 14 from the washer drum. The rotating basket 14 may further contain a plurality of holes 17 throughout its wall to allow fluid communication between the interior of the basket and the washer drum. A motor 3 may be used to drive the rotating basket 14 to induce rotation within the washer drum. Suitable drive system alternatives, presented for illustration and without limitation include, direct drive, pulley-belt drive, transmissions, and any combination thereof. The direct drive orientation of the rotating basket 14 and the motor 3 is provided for illustrative purposes and it is not intended to imply a restriction to the present invention. In one embodiment of the present invention (not shown in FIG. 1), the motor 3 may have a different major longitudinal axis than the longitudinal axis 220 of the rotating basket 14, and the motor 3 may be coupled to the rotating basket 14 by a pulley and a belt.

Figure 2:
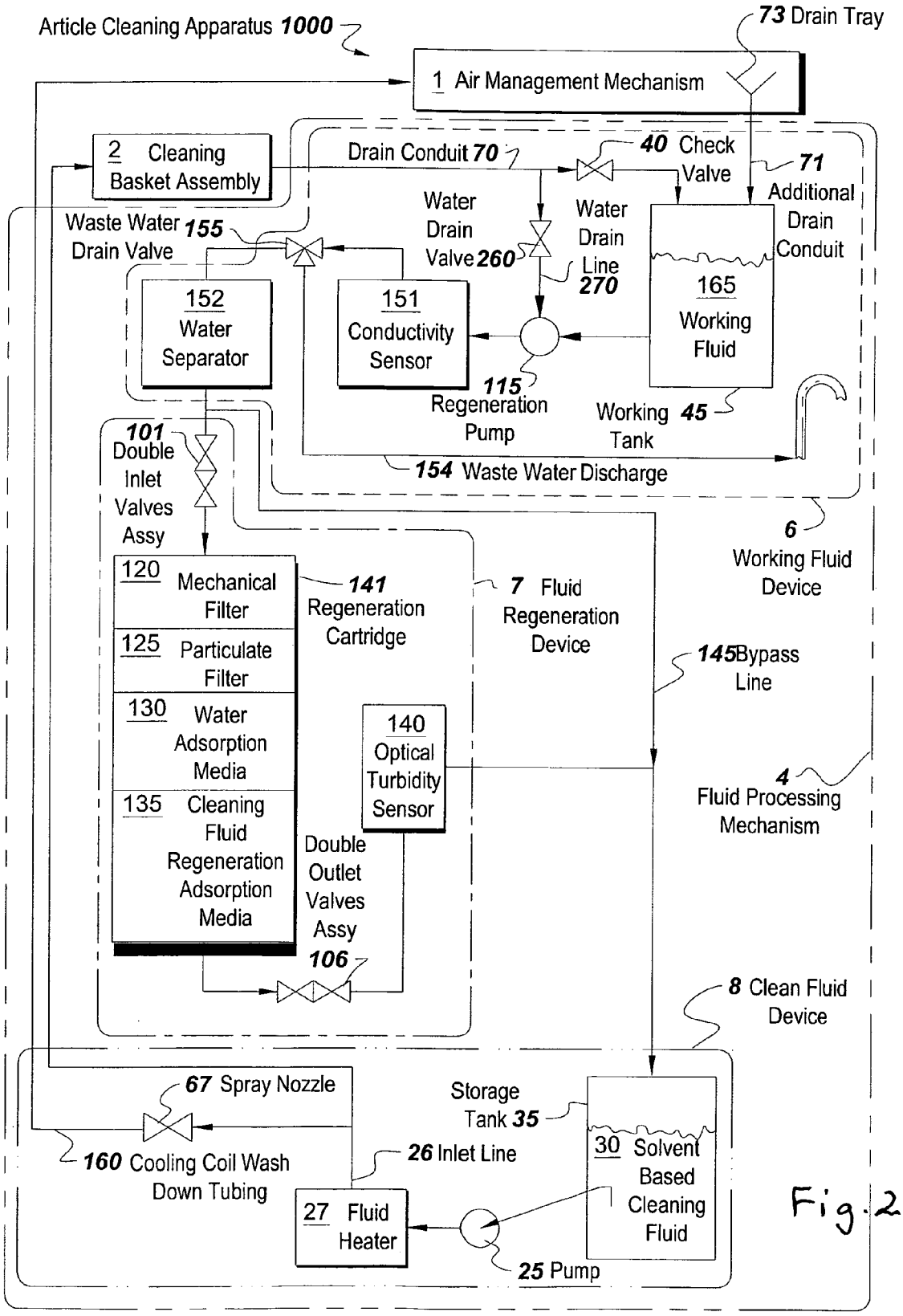
FIG. 2 is a schematic diagram of the fluid processing mechanism in accordance with one embodiment of the present invention.

FIG. 2 illustrates one embodiment of the fluid processing mechanism 4 of FIG. 1. In the illustrated embodiment of FIG. 2, the working fluid device 6 includes a check valve 40 disposed in a drain conduit line 70 that couples the cleaning basket assembly 2 to a working tank 45 (also known as a holding tank). Fluid from the cleaning basket assembly 2 passes through the check valve 40 and is collected in the working tank 45 as working fluid 165. In accordance with one embodiment of the present invention, a drain tray 73 and an additional drain conduit 71 are coupled to the air management mechanism 1 to collect condensate generated in the air management mechanism 1. In one embodiment, the condensate may be composed of separate water and solvent components which are gravity drained directly into the working tank 45 without the assistance of a pump. By draining the condensate directly into the working tank 45 without the use of a pump, it is possible to avoid additional mixing of the water and solvent components which would otherwise occur. In turn, this reduced mixing can advantageously reduce the time it takes to perform solvent recovery as described in further detail below. As further depicted in the illustrated embodiment of FIG. 2, a regeneration pump 115 may be coupled to the working tank 45 and to a conductivity sensor 151. Additionally, a waste water drain valve 155 may further be disposed between the conductivity sensor 151 and the fluid regeneration device 7, and the waste water drain valve 155 may also be coupled to waste water discharge piping 154.

In one embodiment of the present invention, the controller 5 (see e.g., FIG. 1 and FIG. 7) is configured to direct the working fluid 165 through to the fluid regeneration device 7 when the conductivity sensor 151 indicates that the working fluid 165 comprises less than about 10% water by weight. In one embodiment, the controller 5 is further configured to divert the working fluid 165 of FIG. 2 through the waste water drain valve 155 and the waste water discharge piping 154 when the working fluid 165 flowing through the conductivity sensor 151 comprises a minimum of at least about 10% by weight of water. This is to avoid overwhelming the water adsorption capability of the fluid regeneration device 7.

In accordance with one embodiment of the present invention, a water separator may be utilized to facilitate separation and removal of the water from the solvent based cleaning fluid as part of a solvent recovery process. Such water removal may be desirable to improve carbon adsorption efficiency and further to reduce odors and solvent fouling often associated with bacterial growth within the aqueous phase. In the illustrated embodiment of FIG. 2, a water separator 152 is disposed between the waste water drain valve 155 and the fluid regeneration device 7. However, in other embodiments, the water separator 152 may disposed in other locations within article cleaning apparatus 1000, such as for example within working tank 45. In one embodiment of the present invention, the water separator 152 may be fabricated from materials including but not limited to calcined clay, water adsorbing polymers, sodium sulfate, paper, cotton fiber, lint, and any combination thereof.

In another embodiment of the present invention, a bypass line 145 of FIG. 2 is disposed between the outlet of the water separator 152 and the inlet of the clean fluid device 8 to reduce the possibility of overwhelming the water removal capability in the fluid regeneration device 7. In another embodiment of the present invention (not shown in FIG. 2), the bypass line 145 may be disposed between the waste water drain valve 155 and the clean fluid device 8. The bypass line 145 is typically sized to bypass a range from about one-quarter to about three-quarters of the total flow of the working fluid 165 around the fluid regeneration device 7.

Figure 17:
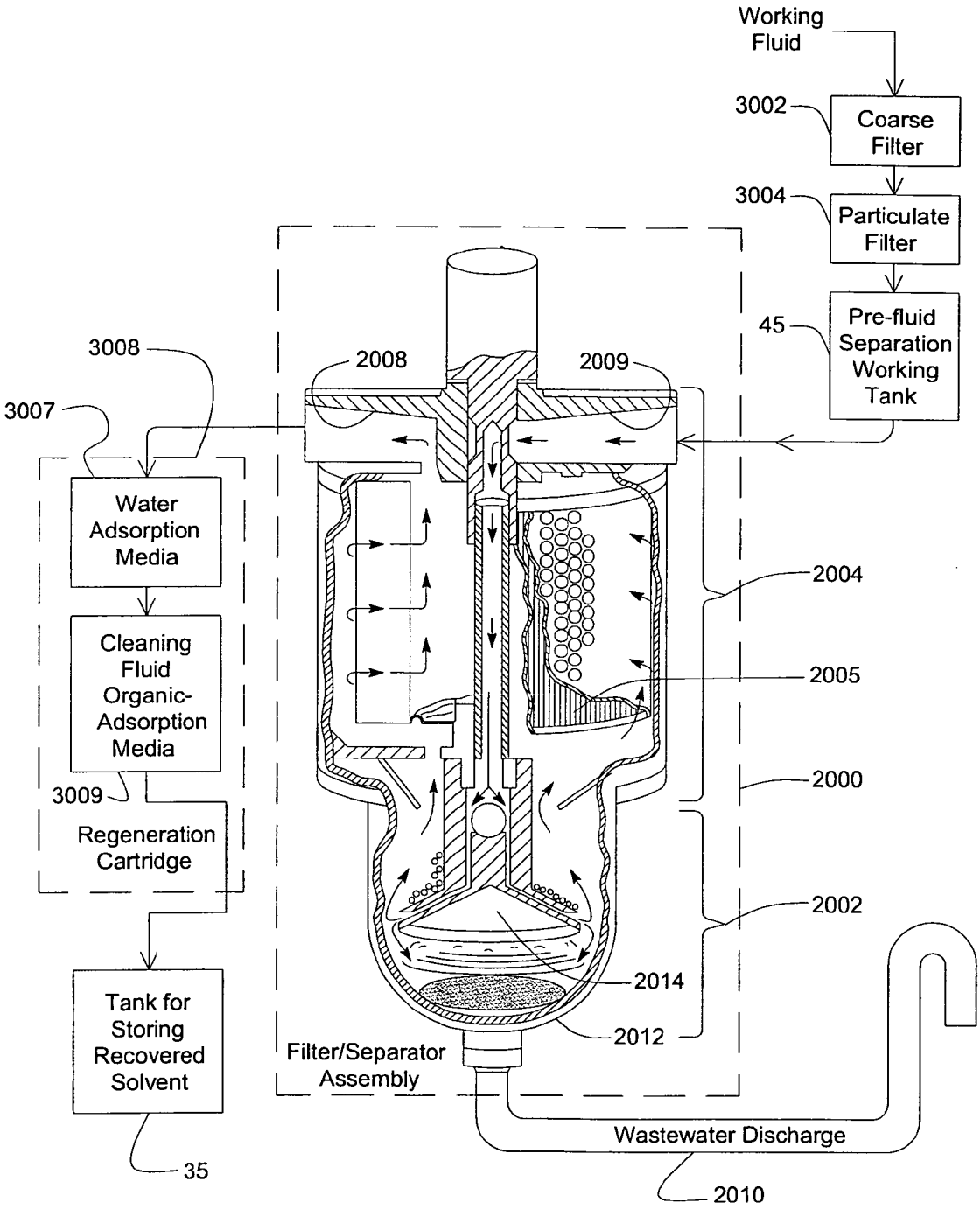
FIG. 17 is a schematic diagram of a solvent purification system including a filter/separator assembly in accordance with one embodiment of the invention.

FIG. 17 illustrates a fluid filter/separator assembly 2000 comprising a decanter stage 2002 and a filter stage 2004 for separating water from the solvent based cleaning fluid. The decanter stage 2002 and filter stage 2004 may be viewed as one exemplary embodiment of the water separator 152 of FIG. 2.

In one embodiment, water and/or detergent (bottom or aqueous phase) that may be present in the working fluid 165 may be separated from the solvent based cleaning fluid by filter/separator assembly 2000. Decanter stage 2002 may be comprised of a waste water discharge tube 2010, a water collector bowl 2012 and a turbine centrifuge 2014. In operation, decanter stage 2002 is in fluidic communication with filter stage 2004, as represented by the plurality of arrows indicative of various exemplary fluid flow paths shown in filter/separator assembly 2000. Filter stage 2004, in one exemplary embodiment, may be made of paper. In another exemplary embodiment, filter stage 2004 may comprise hydrophobic material, e.g., a polymer or resin-coated paper, designed to concentrate and contain the aqueous phase within the decanter while allowing passage to the non-polar phase, e.g., solvent. In one exemplary embodiment, the filter stage may comprise a single-ply, axially-pleated filter media 2005. As suggested above, the filter media may be treated to block any fine droplets of water from passing though the filter/separator assembly 2000 with the solvent.

One exemplary type of hydrophobic media believed to be effective for such purposes described herein, is manufactured by Parker-Hannifin Corporation of Cleveland Ohio under the mark/designation Aqua-bloc. It will be understood that the composition, structure and efficiency of the filter media can be configured to match the particular needs of any given application. It will be appreciated that the filter media may be formed from conventional material and may be manufactured using conventional filter media manufacturing techniques. Commercially available filter/separator assemblies that are well suited to perform decanting and coalescing include, for example, the Amsoil/Dahl filter/separator assemblies Model Nos. ADF10, and ADF20, and the Racor filter/separator assembly Model No. 1000FG. Each of such filter/separator assemblies have been designed and used for fuel systems, such as diesel fuel systems, to remove water, the more dense phase, from the diesel fuel, which is slightly less dense, thereby allowing for clean, water-free fuel to pass for optimal engine performance. The inventors of the present invention have innovatively recognized that such fuel filter/separator assemblies may be advantageously used for achieving aspects of the present invention, such as removing the denser water phase from the slightly less dense, but immiscible silicone cleaning fluid (i.e., cyclic siloxane solvent).

Figure 18:
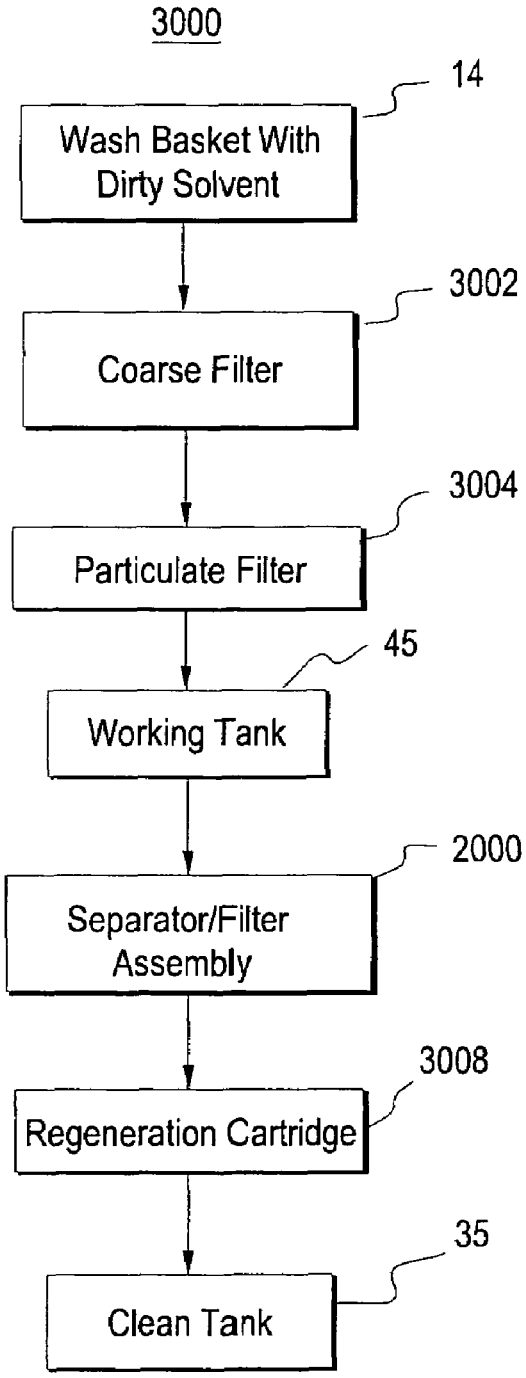
FIG. 18 illustrates an exemplary process flow for performing recovery and purification of dirty solvent using the solvent purification system of FIG. 17.

FIG. 18 illustrates an exemplary process flow 3000 for performing recovery and purification of dirty solvent and/or cleaning agents within article cleaning apparatus 1000 of FIG. 1. For example, after clothes have been washed in the rotating basket 14, the dirty cleaning fluid may be drained from the wash basket 14, and passed through a coarse filter 3002 such as a lint filter. This filter may have a relatively large mesh configured to remove lint or fibers, which may be loosened from the clothing during wash and remain in the contaminated solvent upon draining of the wash basket. Coarse filter 3002 may be viewed as one exemplary embodiment of mechanical filter 120 (FIG. 2). As such, unless otherwise stated, the structural description provided for mechanical filter 120 is also applicable to coarse filter 3002. Once the dirty cleaning fluid is passed through a coarse filter 3002, the fluid from coarse filter 3002 may then be passed through a particulate filter 3004 configured to trap smaller particulates not otherwise trapped by coarse filter 3002. In one embodiment, particulate filter 3004 may comprise, for example, a spun or wound cartridge filter made up of polypropylene or polyester. Since particulate filter 3004 may be viewed as one exemplary embodiment of particulate filter 125 (FIG. 2), unless stated otherwise, the structural description provided for particulate filter 125 is also be applicable to particulate filter 3004.

Figure 3:
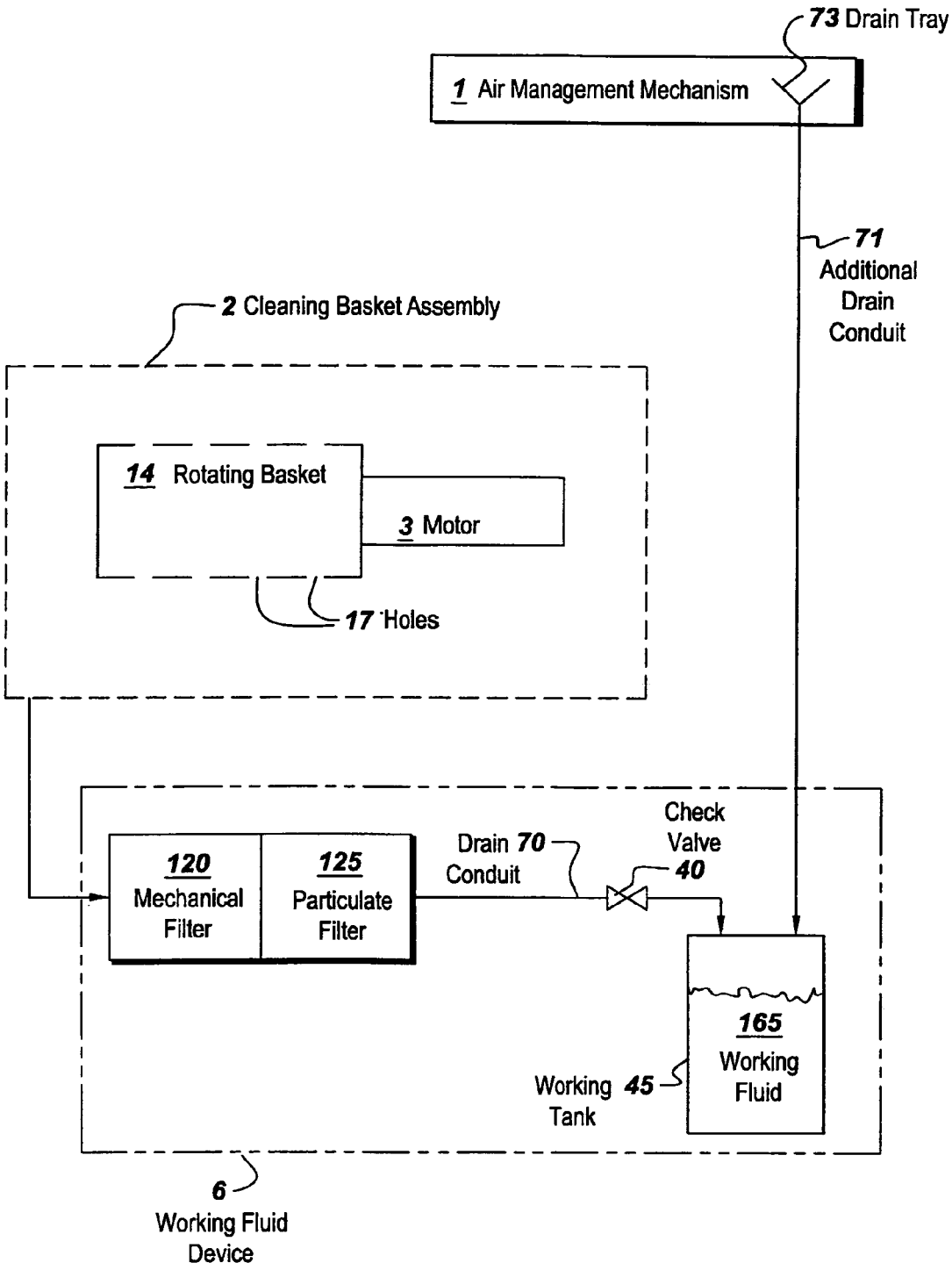
FIG. 3 is a schematic diagram of a filter arrangement in accordance with one embodiment of the present invention.

After passing the cleaning fluid through the coarse and particulate filters to capture solids, the cleaning fluid may be optionally stored in the working tank 45 for further purification processing (see e.g., FIG. 3). In one exemplary embodiment, the purification process may continue immediately upon receiving fluid into the working tank. However, in an alternative embodiment, the fluid may be stored in the working tank 45 for later purification.

As described above with respect to FIG. 17, bulk water separation is performed through filter/separator assembly 2000. Impurities in the solvent that may pass from filter/separator assembly 2000 could be concentrated and removed via distillation. However, this is typically not practical in residential or non-commercial applications. In one exemplary embodiment, a regeneration cartridge 3008 may be configured to function as an impurity concentrator that may comprise an adsorption column. Regeneration cartridge 3008, water adsorption media 3007, and an organic adsorption media 3009 may each be viewed as respective exemplary embodiments of regeneration cartridge 141, water adsorption media 130 and cleaning fluid regeneration adsorption media 135, each shown in FIG. 2. Thus, unless stated otherwise, the structural description respectively provided for each of the last-recited components may also be applicable to regeneration cartridge 3008, water adsorption media 3007, and organic adsorption media 3009. In one exemplary embodiment, regeneration cartridge 3008 may be comprised of at least two sections including for example, the water adsorption media 3007 and organic adsorbent media 3009. The water adsorption media 3007, such as calcined clay, facilitates the removal of small amounts of residual water not removed through the fluid separation action provided by filter/separator assembly 2000, while the organic adsorbent media 3009, e.g. carbon, may be arranged to adsorb dissolved organic impurities, such as fats and oils. In one exemplary embodiment, the organic adsorption media 3009 may be a packed bed column with a length-to-diameter ratio of at least two. However, the organic adsorbent media may comprise a spin filter, flat plate bed, tortuous path bed, membrane separator, or other similar adsorption arrangement. The flow direction may be upflow or downflow, horizontal, or radial flow, although it may be desirable to minimize channeling for superior adsorption performance. The organic adsorption media may be selected from any material that is effective for removing dissolved organic impurities, such as activated carbon, carbon nanotubes, clay, adsorption resins (especially carbonaceous type, e.g., Ambersorb 563), silica, alumina, and zeolites. In one exemplary embodiment, activated carbon is used because of its high adsorption capacity and relatively low cost.

As suggested above, the adsorption media may comprise an array of packed bed columns or cartridges and may be in the form of a single cartridge or groups of cartridges in parallel and/or series. Cartridges coupled in parallel may provide a more convenient size for handling and can increase the L/D ratio of the cartridge bed without changing the total cartridge volume. Cartridges coupled in series can increase adsorption capacity as well as increase processing speed. A design with multiple cartridges may also be placed on a carousel for accessibility and ease of replacement.

Means for introducing additives, such as detergents, perfumes, disinfectants, etc., may be positioned at or near the exit side of the organic adsorption media 3009. This way such additives may be dispensed into the solvent exiting the column for a subsequent wash as the solvent from a present or a previous wash is purified for storage in the clean storage tank 35.

Additional details of the filter/separator assembly 2000 and the regeneration cartridge 3008 and their various embodiments within the article cleaning apparatus are described in co-pending and commonly assigned U.S. patent application Ser. No. 10/330,734, entitled "System And Method For Solvent Recovery And Purification In A Low Water Or Waterless Wash", filed Dec. 20, 2002.

Referring back to FIG. 2 once again, the fluid regeneration device 7 comprises a regeneration cartridge 141 as shown. The inlet side of the regeneration cartridge 141 is typically coupled to the working fluid device 6. The regeneration cartridge 141 typically comprises at least a water adsorption media 130 coupled to a cleaning fluid regeneration adsorption media 135. In one embodiment of the present invention, the regeneration cartridge 141 further comprises a mechanical filter 120 and a particulate filter 125. In one embodiment of the present invention, the working fluid 165 passes sequentially through the mechanical filter 120, particulate filter 125, water adsorption media 130, and cleaning fluid regeneration adsorption media 135. The cleaning fluid regeneration adsorption media 135 contains a portion of the solvent based cleaning fluid 30 in order to replenish the solvent based cleaning fluid 30 that is consumed during the solvent wash/dry process 500 of FIG. 13. The cleaning fluid regeneration adsorption media 135 also contains a replacement amount of solvent based cleaning fluid 30 which is disposed of when changing out the regeneration cartridge 141.

In one embodiment of the present invention, the cleaning fluid regeneration adsorption media 135 is selected from a group consisting of a packed bed column, a flat plate bed, a tortuous path bed, a membrane separator, a column with packed trays, and combinations thereof.

In one embodiment of the present invention, the materials used to fabricate the cleaning fluid regeneration adsorption media 135 may be selected from the group consisting of activated charcoal, carbon, calcined clay, Kaolinite, adsorption resins, carbonaceous type resins, silica gels, alumina in acid form, alumina in base form, alumina in neutral form, zeolites, molecular sieves, and any combination thereof. Both the amount of solvent based cleaning fluid regeneration and the speed of solvent based cleaning fluid regeneration depend on the volume of the cleaning fluid regeneration adsorption media 135.

In one embodiment of the present invention, the regeneration cartridge 141 containing the cleaning fluid regeneration adsorption media 135 in the packed bed column form is disposed in a single packed bed column cartridge form. In another embodiment of the present invention, the regeneration cartridge 141 comprising the cleaning fluid regeneration adsorption media 135 in the packed bed column form is disposed in a plurality of packed bed column cartridges. In an alternative embodiment of the present invention, the regeneration cartridge 141 comprises the cleaning fluid regeneration adsorption media 135 in a plurality of packed bed column cartridges, which are disposed in series with respect to one another. In yet another embodiment of the present invention, the regeneration cartridge 141 further comprises the cleaning fluid regeneration adsorption media 135 in the plurality of packed bed column cartridges, which are disposed in parallel with respect to one another.

In another embodiment of the present invention, the mechanical filter 120 of FIG. 3 and the particulate filter 125 are part of the working fluid device 6. The mechanical filter 120 and the particulate filter 125 are disposed in the drain conduit line 70 that couples the cleaning basket assembly 2 to the working tank 45. The mechanical filter 120 and the particulate filter 125 are disposed in the drain conduit 70 between the cleaning basket assembly 2 and the check valve 40.

Figure 4:
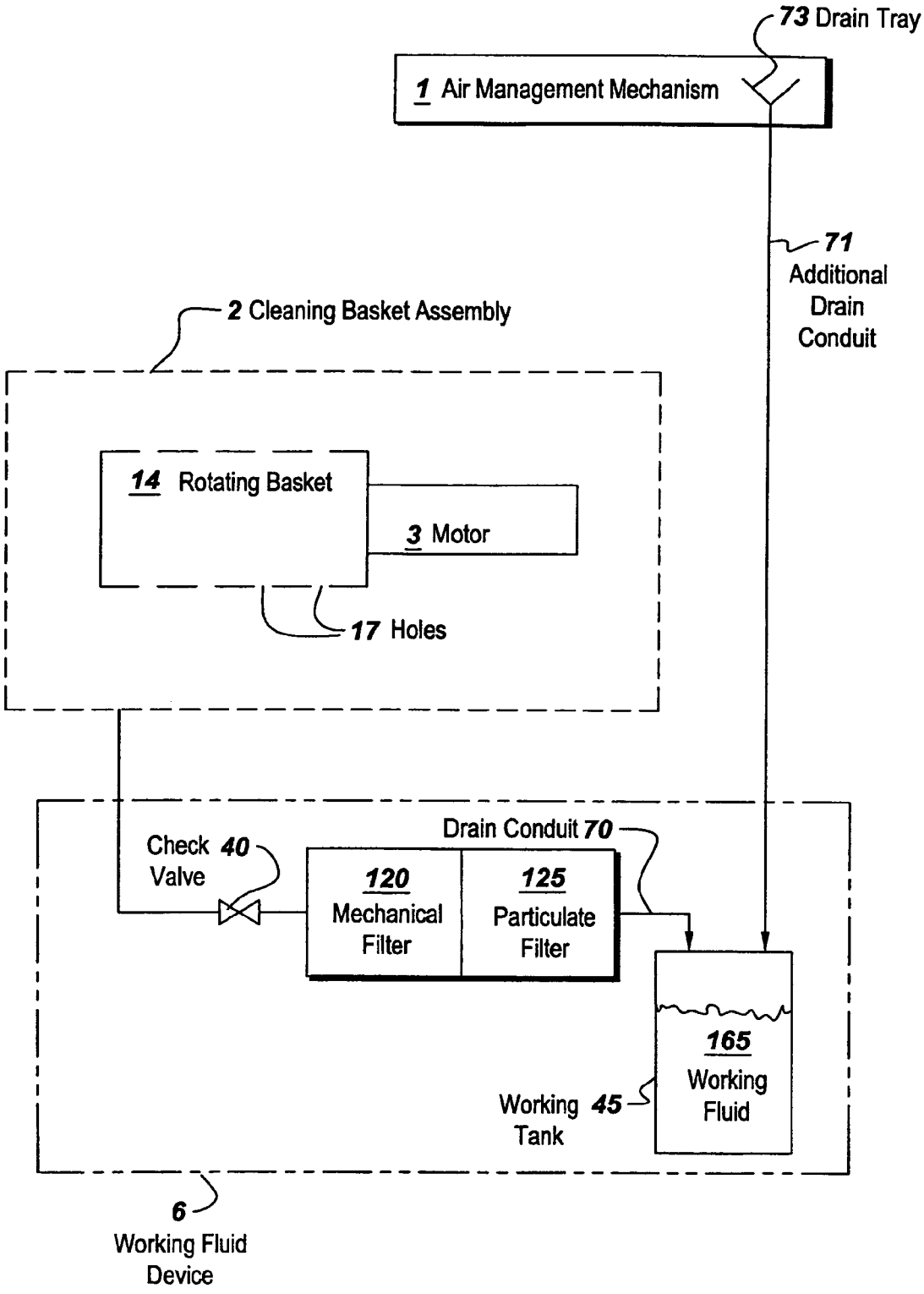
FIG. 4 is a schematic diagram of a filter arrangement in accordance with another embodiment of the present invention.

In another embodiment of the present invention, the mechanical filter 120 of FIG. 4 and the particulate filter 125 are disposed in the drain conduit 70 between the check valve 40 and the working tank 45. In an alternative embodiment of the present invention, the mechanical filter 120 is disposed in the drain conduit 70, while the particulate filter 125 is disposed in the regeneration cartridge 141. In another embodiment of the present invention, the mechanical filter 120 is not present and the particulate filter 125 is disposed in the regeneration cartridge filter 141. In another embodiment of the present invention, the mechanical filter 120 is not present and the particulate filter 125 is disposed in the drain conduit 141. Both the arrangement of the internals of the regeneration cartridge 141 and the location and application of the mechanical filter 120 and the particulate filter 125 are provided for illustrative purposes and are not intended to imply a restriction on the present invention.

In one embodiment of the present invention, mechanical filter 120 has a mesh size in a range from about 50 microns to about 1000 microns. In one embodiment of the present invention, the particulate filter 125 has a mesh size in a range from about 0.5 microns to about 50 microns. In one embodiment of the present invention, the particulate filter 125 is a cartridge filter fabricated from materials selected from the group consisting of thermoplastics, polyethylene, polypropylene, polyester, aluminum, stainless steel, metallic mesh, sintered metal, ceramic, membrane diatomaceous earth, and any combination thereof.

Figure 9:
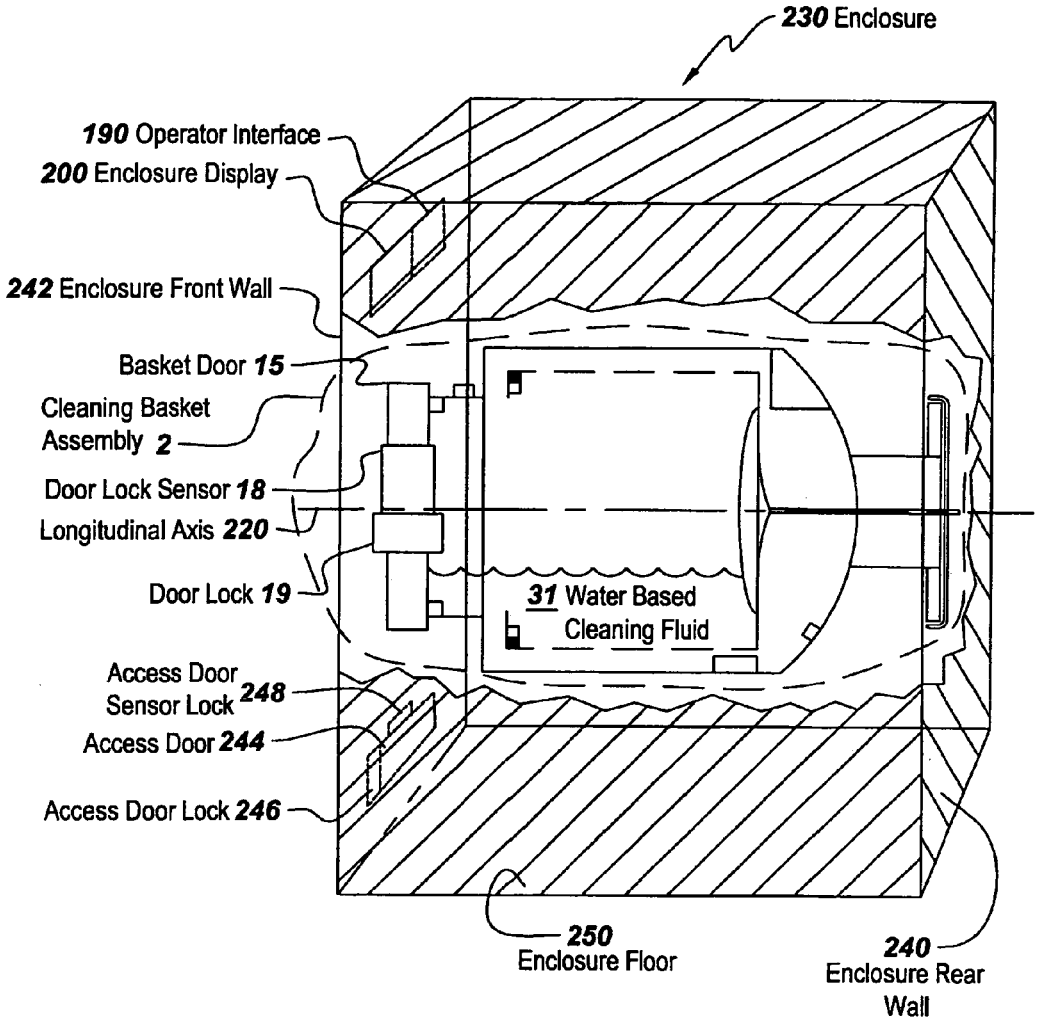
FIG. 9 is a three-dimensional partial cross sectional view of the article cleaning apparatus in accordance with one embodiment of the present invention.

After the working fluid 165 passes through the regeneration cartridge 141, it exits the regeneration cartridge 141 as the solvent based cleaning fluid 30. An outlet side of the regeneration cartridge 141 is typically coupled to an optical turbidity sensor 140. The optical turbidity sensor 140 is typically coupled to the clean storage tank 35 in the clean fluid device 8. The optical turbidity sensor 140 is tuned to a specific adsorbance level that provides information about the cleanliness of the solvent based cleaning fluid 30. When the solvent based cleaning fluid 30 exiting the optical turbidity sensor 140 reaches a preset specific adsorbance level, the controller 5 of FIG. 7 sends a "replace regeneration cartridge" message to the operator on a display panel 200 (FIG. 9).

Figure 7:
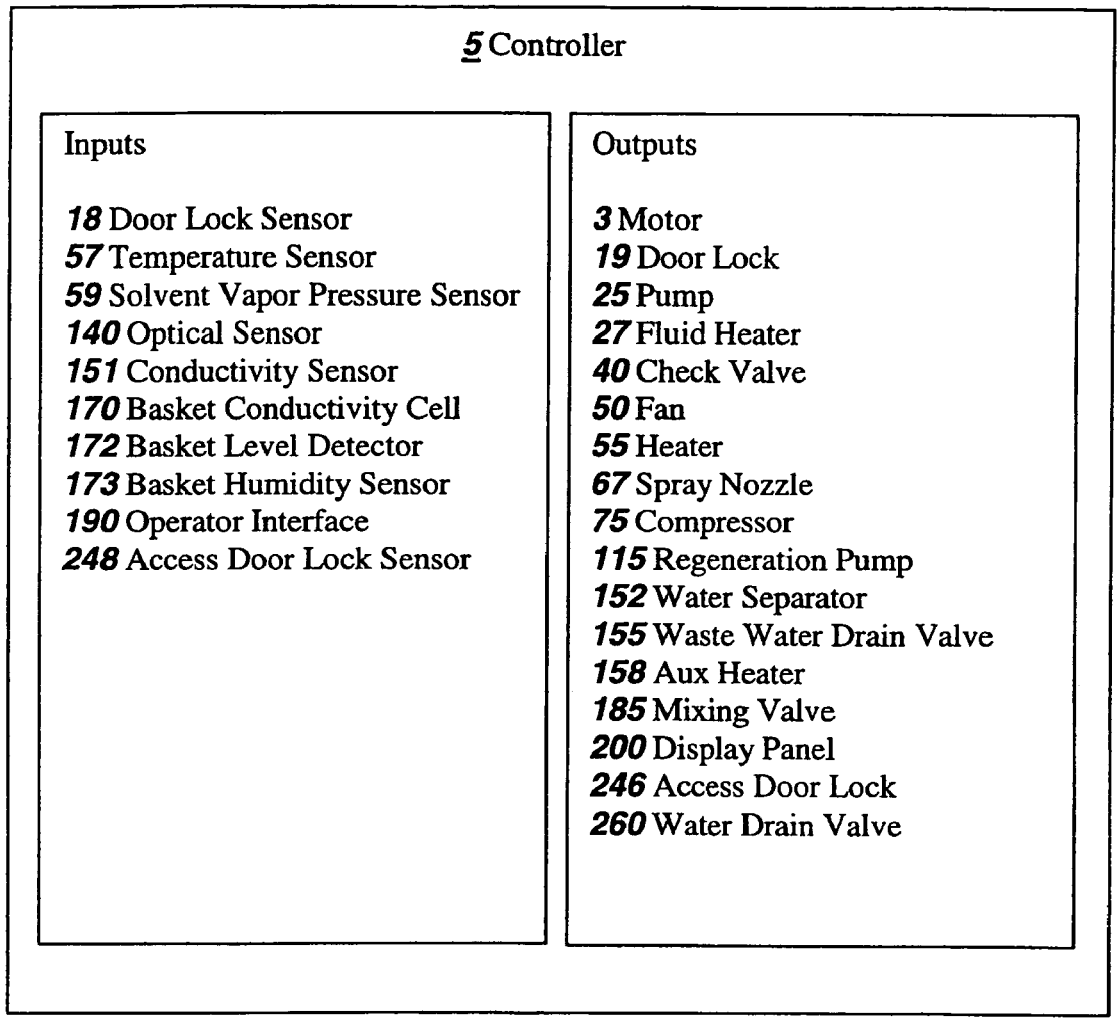
FIG. 7 is a schematic diagram of the devices coupled to the controller in accordance with one embodiment of the present invention.

The clean storage tank 35 of FIG. 2 in the clean fluid device 8 stores the solvent based cleaning fluid 30 received from the fluid regeneration device 7. The clean fluid device 8 further comprises a pump 25 that is coupled to the clean storage tank 35. In one embodiment of the present invention, the pump 25 may be a low mixing pump designed to impart low turbulence in the cleaning fluid flow (as will be described in further detail below with respect to FIG. 19). The pump 25 may be coupled to the cleaning basket assembly 2 via an inlet line 26 and coupled to the air management mechanism 1 via cooling coil wash down tubing 160. In another embodiment of the present invention, the clean fluid device 8 may further comprise a spray nozzle 67 that is disposed in the cooling coil wash down tubing 160 to control the flow of the solvent based cleaning fluid 30 to the air management mechanism 1. As used herein, the term, "spray nozzle" is defined to be a nozzle, an orifice, a spray valve, a pressure reducing tubing section, and any combination thereof. In one embodiment of the present invention, the spray nozzle 67 is coupled to the controller 5 as is shown in FIG. 7 when the spray nozzle 67 is a spray valve.

Figure 5:
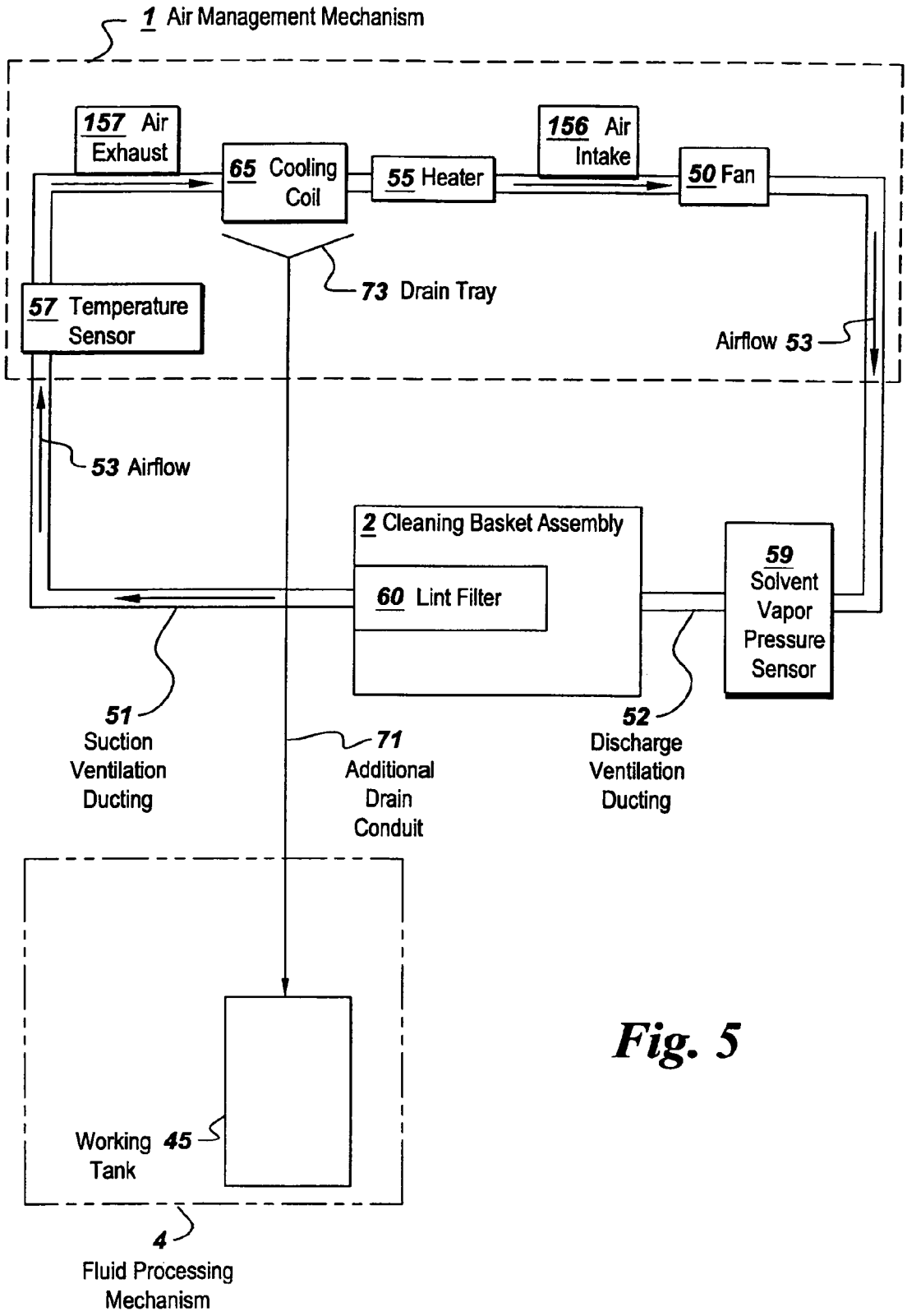
FIG. 5 is a schematic diagram of the air management mechanism and the cleaning basket assembly in accordance with one embodiment of the present invention.

FIG. 5 further illustrates one embodiment of the air management mechanism 1 of article cleaning apparatus 1000. As shown, the air management mechanism 1 of FIG. 5 comprises a cooling coil 65, a heater 55, and a fan 50. The air management mechanism 1 is coupled to the cleaning basket assembly 2 by suction ventilation ducting 51 and discharge ventilation ducting 52. The fan 50 is disposed to provide airflow 53 through the cooling coil 65, the heater 55, the discharge ventilation ducting 52, the cleaning basket assembly 2, and the suction ventilation ducting 51. A temperature sensor 57 is also typically disposed in the airflow 53. The temperature sensor 57 is typically disposed in the suction ventilation ducting 51, the discharge ventilation ducting 52, the cleaning basket assembly 2, and any combination thereof.

The cooling coil 65 is configured to have a cooling medium disposed to flow across one side of a heat transfer surface of the cooling coil 65, while the airflow 53 passes across the opposite side of the heat transfer surface of the cooling coil 65. The heat transfer surface of the cooling coil 65 separates the cooling medium and the airflow 53. The inlet temperature of the cooling medium utilized is typically cooler that the temperature of the airflow 53 in order to condense vapors in the airflow 53. As used herein, the term, "cooling medium" is defined, for illustrative purposes and without limitation, as being selected from water, refrigerants, air, other gasses, ethylene glycol/water mixtures, propylene glycol/water mixtures and any combination thereof. The drain tray 73 is disposed under the cooling coil 65 and is coupled to the working tank 45 as described above.

In one embodiment of the present invention, the air management mechanism 1 may further comprise an air intake 156 and an air exhaust 157. The air intake 156 and air exhaust 157 are disposed to provide air exchange between the airflow 53 and the air that is outside of the air management mechanism 1 to promote the drying of articles that have been subjected to the water cleaning process 600 of FIG. 14. The air intake 156 and air exhaust 157 are disposed in a similar configuration to that of a conventional dryer. In one embodiment of the present invention, the air intake 156 of FIG. 5 is disposed in the ventilation path between the heater 55 and the fan 50, while the air exhaust 157 is disposed between the cooling coil 65 and the cleaning basket assembly 2. The locations of the air intake 156 and air exhaust 157 are provided for illustration and in no way implies a restriction to the present invention.

Figure 6:
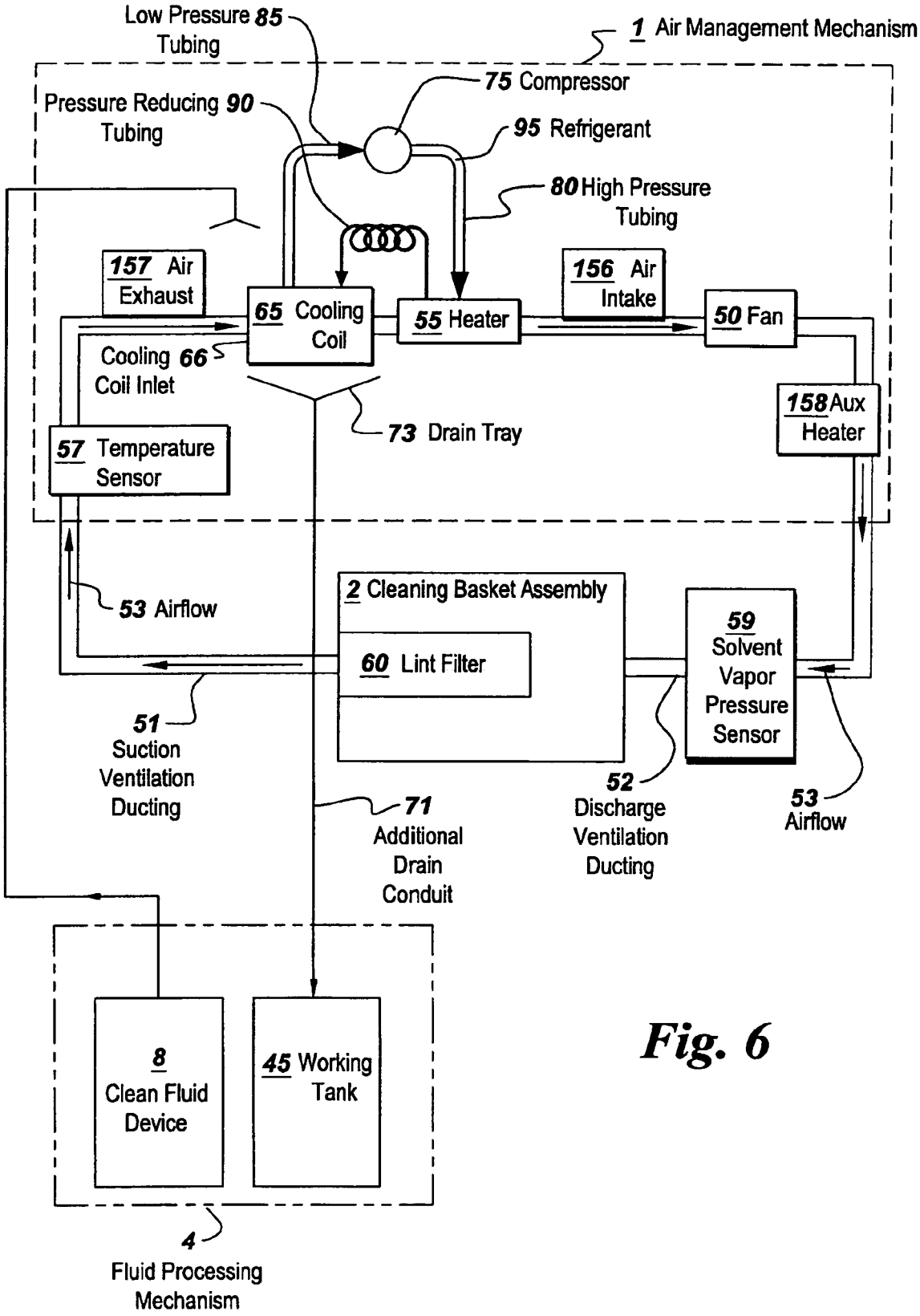
FIG. 6 is a schematic diagram of the air management mechanism and the cleaning basket assembly in accordance with another embodiment of the present invention.

A solvent vapor pressure sensor 59 may detect the vapor pressure of the solvent based cleaning fluid 30 in the airflow 53 that circulates between the cleaning basket assembly 2 and the air management mechanism 1. The solvent vapor pressure sensor 59 is used to determine when solvent vapor pressure level reaches a predetermined level that indicates that the airflow 53 is no longer entraining substantial amounts of the solvent based cleaning fluid 30 of FIG. 2. The solvent vapor pressure sensor 59 of FIG. 6 is disposed in the discharge ventilation ducting 52. In another embodiment of the present invention, the solvent vapor pressure sensor 59 is typically disposed in the suction ventilation ducting 51, the discharge ventilation ducting 52, the cleaning basket assembly 2, and any combination thereof. In one embodiment of the present invention, the solvent vapor pressure sensor 59 replaces the temperature sensor 57.

The cooling coil 65 of FIG. 6 further comprises a cooling coil air inlet 66. In one embodiment of the present invention, one end of the cooling coil wash down tubing 160 is aimed at the cooling coil air inlet 66 of FIG. 6. The spray nozzle 67 and the pump 25 flushes away lint and debris that accumulates on the surface of the cooling coil air inlet 66 of FIG. 6 to maintain airflow 53 (i.e. decrease the pressure drop across the cooling coil 65) through the air management mechanism 1 and the cleaning basket assembly 2. In one embodiment of the present invention, spraying the solvent based cleaning fluid 30 of FIG. 2 at the cooling inlet 66 of FIG. 6 provides additional cooling and condensation of vapor in the airflow 53.

As shown in FIG. 6, in another embodiment of the present invention, the air management mechanism 1 further comprises a compressor 75, high-pressure tubing 80, low-pressure tubing 85 and pressure reducing tubing 90 are disposed in a vapor compression cycle. As used herein, the term, "high-pressure tubing" is used to indicate that the high-pressure tubing is designed to contain a refrigerant 95 at a higher pressure than the "low-pressure tubing". The use of the terms "high-pressure tubing" and "low-pressure tubing" are used to express a relative pressure differential across the compressor 75. As used herein, the term, "pressure reducing tubing" is defined to indicate that the "pressure reducing tubing" comprises a flow restriction that is sufficient to provide the relative pressure differential at a junction between the "high-pressure tubing" and the "low-pressure tubing". The high-pressure tubing 80 of FIG. 6 is disposed from the compressor 75 to the heater 55. The pressure reducing tubing 90 is disposed between the heater 55 and the cooling coil 65. The low-pressure tubing 85 is disposed from the compressor 75 to the cooling coil 65. The refrigerant 95 is disposed to flow between the compressor 75, heater 55, and cooling coil 65.

Figure 13:
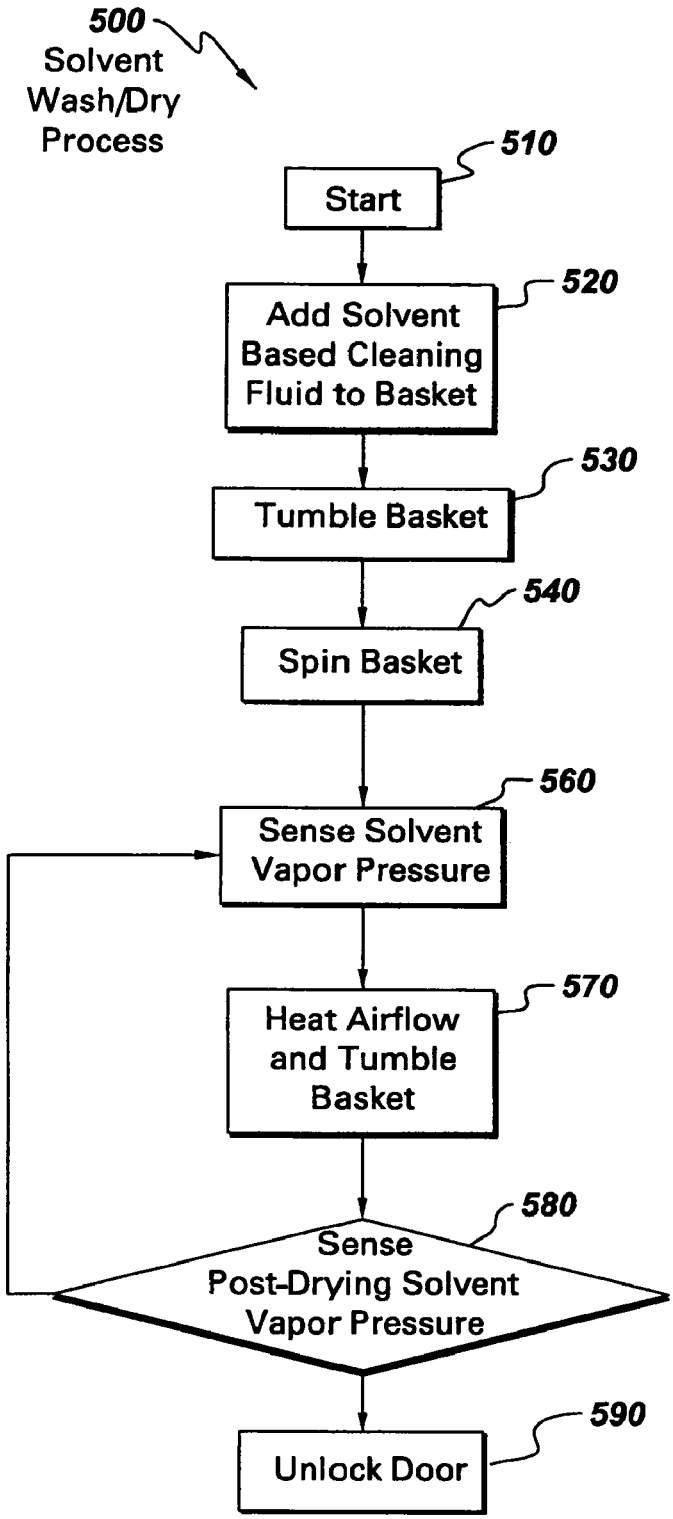
FIG. 13 is a flow diagram of a solvent cleaning process in accordance with one embodiment of the present invention.

The vapor compression cycle attains a higher coefficient of performance (COP) for solvent wash/dry process 500 of FIG. 13. The vapor compression cycle operating in a heat pump configuration reduces energy requirements for the solvent cleaning process 375 of FIG. 11. Energy is conserved as the refrigerant 95 of FIG. 6 passing through the cooling coil 65 adsorbs heat from the airflow 53 and then the refrigerant 95 rejects the heat back into the airflow 53 by passing through the heater 55. In one embodiment of the present invention, the refrigerant 95 is fluorocarbon R-22; however, other refrigerants known to one skilled in the refrigerant art would be acceptable. The heater 55 functions as a condenser (warming the air flow 53 through the heater 55), while the cooling coil 65 functions as an evaporator (cooling the air flow 53 through the cooling coil 65 and condensing any vapor).

In another embodiment of the present invention, the air management mechanism 1 further comprises an auxiliary heater 158 of FIG. 6. The fan 50 is further disposed to provide airflow 53 through the auxiliary heater 158. Typically, the auxiliary heater 158, used in conjunction with the heater 55, provides a higher temperature in the airflow 53 that enters the cleaning basket assembly 2. The auxiliary heater 158 is disposed in the discharge ventilation ducting 52. In another embodiment of present invention, the auxiliary heater 158 is disposed in the suction discharge ventilation ducting 53. Raising the air temperature of the airflow 53 typically decreases the drying time for the articles in the humidity sensing process 400 of FIG. 12 and the solvent wash/dry process 500 of FIG. 13.

The inputs to the controller 5 of FIG. 7 are typically selected from the group consisting of the door lock sensor 18, the temperature sensor 57, the solvent vapor pressure sensor 59, the optical sensor 140, the conductivity sensor 151, the basket conductivity cell 170, the basket level detector 172, the basket humidity sensor 173, the operator interface 190, the access door lock sensor 248, and any combination thereof. The outputs of the controller 5 are typically selected from the group consisting of the motor 3, the door lock 19, the pump 25, the fluid heater 28, the check valve 40, the fan 50, the heater 55, the spray nozzle 67, the compressor 75, the regeneration pump 115, the water separator 152, the waste water drain valve 155, the auxiliary heater 158, the mixing valve 185, the display panel 200, the access door lock 246, the water drain valve 260, and any combination thereof.

The controller 5 is further configured to perform a solvent based cleaning fluid recirculation process. In the solvent based cleaning fluid recirculation process, the solvent based cleaning fluid 30 passes through the fluid processing mechanism 4 and cleaning basket assembly 4 as discussed above for a predetermined amount of time.

Figure 11:
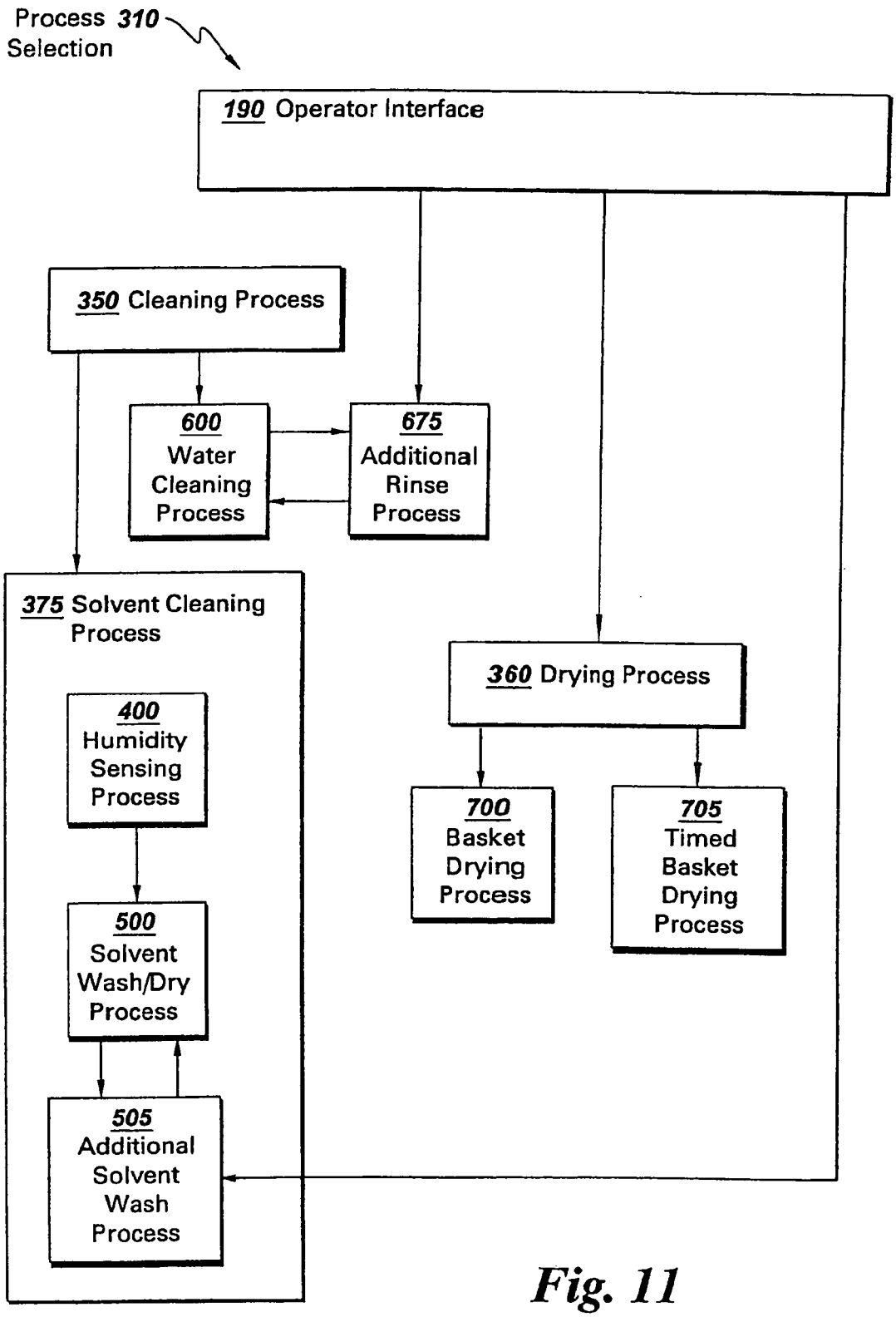
FIG. 11 is a block diagram of the process selection in accordance with one embodiment of the present invention.

In one embodiment, the solvent based cleaning fluid recirculation process is performed when the article cleaning apparatus 1000 is not engaged in either the cleaning process 350 of FIG. 11 or the drying process 360. In the case where the operator selects either the cleaning process 350 or the drying process 360 during the solvent based cleaning fluid recirculation process, the controller 5 recovers the article cleaning apparatus 1000 using a cycle interruption recovery process 800 of FIG. 16, which will be subsequently described in detail. As used herein, the term, "recovers the article cleaning apparatus," relates to placing the article cleaning apparatus 1000 in a condition to perform either the cleaning process 350 or the drying process 360.

Figure 8:
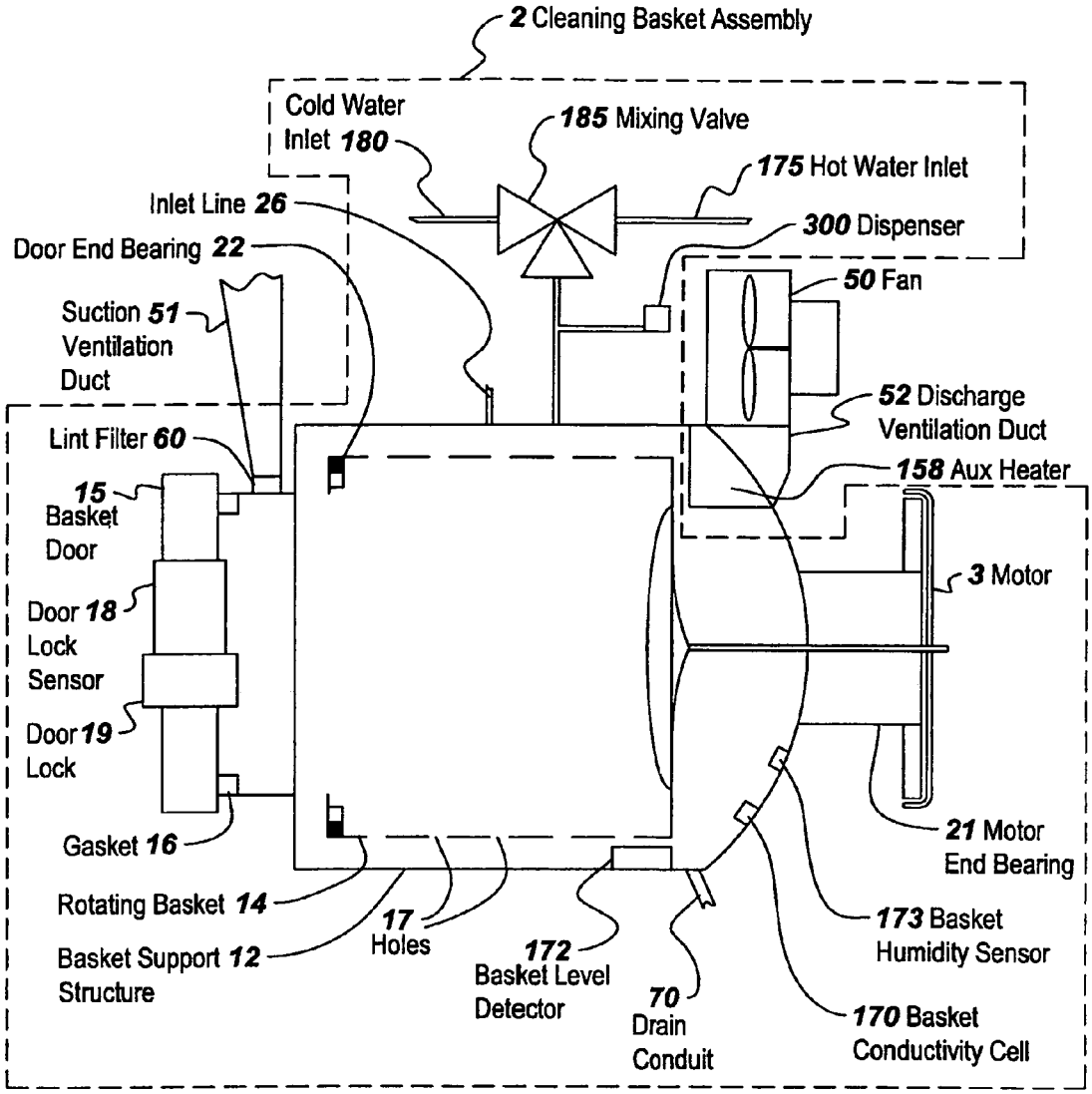
FIG. 8 is a schematic cross sectional view of the cleaning basket assembly in accordance with one embodiment of the present invention.

The cleaning basket assembly 2 of FIG. 8 depicts one embodiment of the present invention where a cleaning basket support structure 12 supports the rotating basket 14 through a door end bearing 22 and a motor end bearing 21. The motor 3 is disposed to the rotating basket 14 at the opposite end of the rotating basket where a basket door 15 is disposed. The cleaning basket assembly 2 further comprises a gasket 16, a door lock sensor 18, and a door lock 19. The basket support structure 12 further comprises a liquid drain connection to the drain conduit 70 and a solvent based cleaning fluid supply connection to the inlet tubing 26. The basket support structure 12 further comprises a connection to the discharge ventilation ducting 52 and a connection to the suction ventilation ducting 51. A lint filter 60 is typically situated in the suction ventilation ducting 51. The cleaning basket assembly 2 of FIG. 8 further comprises a basket humidity sensor 173 that has the capability to determine the humidity level in the rotating basket 14. In one embodiment of the present invention, the basket humidity sensor 173 is disposed inside the basket support structure 12 adjacent the rotating basket 14.

The air management mechanism 1 of FIG. 1, the cleaning basket assembly 2, fluid processing mechanism 4, and the controller 5 are disposed inside an enclosure 230 of FIG. 9, where only the cleaning basket assembly 2 is depicted in the cut away view of the enclosure 230. Additionally, the controller 5 of FIG. 7 is configured to receive input controls from the operator from an operator interface 190 of FIG. 9 and configured to provide a cleaning status at the display panel 200. The enclosure 230 further comprises an enclosure floor 250 that is substantially perpendicular to an enclosure rear wall 240. The rotating basket 14 has a longitudinal axis 220 that is about parallel to the enclosure floor 250. As used herein, the term, "about parallel" is defined to include a range from about −3 degrees to about +3 degrees from parallel. The enclosure 230 further comprises an enclosure front wall 242 that is on the side of the enclosure where the basket door 15 is disposed. In one embodiment of the present invention, the operator interface 190 and the display panel 200 are disposed on the enclosure front wall 242. The location of the operator interface 190 and the display panel 200 is provided by way of illustration and is not intended to imply a limitation to the present invention. In one embodiment of the present invention, the enclosure floor 250 is configured to act as a containment pan to collect leakage of the solvent based cleaning fluid 30. In another embodiment of the present invention, the enclosure 230 is configured to act as the containment pan to collect leakage of the solvent based cleaning fluid 30.

In one embodiment of the present invention, the enclosure 230 has an overall volumetric shape of about 0.7 meters in width, by about 0.9 meters in depth, by about 1.4 meters in height. This volumetric shape represents the typical space available in an in-home laundry setting.

The regeneration cartridge 141 of FIG. 2 is typically the one item in the fluid processing mechanism 4 requiring periodic replacement. In one embodiment of the present invention, the enclosure front wall 242 of FIG. 9 comprises an access door 244, an access door lock 246, and an access door lock sensor 248. The location of the access door 244, access door lock 246 and the access door lock sensor 248 is provided by way of illustration and is not intended to imply a limitation to the present invention. The access door lock 246 and access door lock sensor 248 are coupled to the controller 5 of FIG. 7. The controller logic in the controller 5 keeps the access door lock 246 locked during the cleaning process 350 of FIG. 11, the drying process 360, and the solvent based cleaning fluid recirculation process. The controller logic only permits replacing the regeneration cartridge 141 of FIG. 2 when the article cleaning apparatus 1000 is not operating any of the following: the cleaning process 350 of FIG. 11, the drying process 360 and the solvent based cleaning fluid recirculation process. When the controller logic verifies that any of the following: the cleaning process 350 of FIG. 11, the drying process 360, and the solvent based cleaning fluid recirculation process are not in progress, then the controller 5 of FIG. 7 unlocks the access door lock 246 in response to an operator request via the operator interface 190 to replace the regeneration cartridge 141. If an operator requests to replace the regeneration cartridge 141 and the article cleaning apparatus 1000 is operating any process, the operator is notified that the replacement of the regeneration cartridge 141 is not permitted via a notification message displayed on the display panel 200. By not permitting the cleaning process 350 of FIG. 11, the drying process 360, and the solvent based cleaning fluid recirculation process to be performed by the article cleaning apparatus 1000 of FIG. 2 during the regeneration cartridge 141 replacement, the operator is afforded protection from an inadvertent exposure to the solvent based cleaning fluid 30. Additionally, the controller logic does not allow the article cleaning apparatus 1000 to initiate any process until the access door lock sensor 248 of FIG. 9 verifies that the access door 244 is shut and the access door lock 246 is locked. The access door lock sensor 248 is additionally configured to detect that the regeneration cartridge 141 of FIG. 2 is properly installed before indicating that the access door 244 of FIG. 9 is properly closed and that the access door lock 246 is properly locked.

Additionally, in one embodiment of the present invention, the regeneration cartridge 141 of FIG. 2 further comprises a leak proof double inlet valves assembly 101 and a leak proof double outlet valves assembly 106 to reduce the operator's contact with the solvent based cleaning fluid 30. In another embodiment of the present invention, the regeneration cartridge 141 (not shown in FIG. 2) further comprises a leak proof single inlet valve assembly 100 and a leak proof single outlet valve assembly 105 to reduce the operator's contact with the solvent based cleaning fluid 30. As used herein, the term, "leak proof" is defined to mean that there is no leakage of the solvent based cleaning fluid 30 beyond about 1 ml evident at 1) either end of the regeneration cartridge 141 after removal and 2) the connection points where the regeneration cartridge 141 installs into the fluid regeneration device 7.

The controller logic in the controller 5 of FIG. 7 is designed to keep the basket door lock 19 locked shut while performing any of the following: the cleaning process 350, the drying process 360, and the solvent based cleaning fluid recirculation process. This limits the operator's ability to expose oneself to the solvent based cleaning fluid 30 during any of the following: the cleaning process 350, the drying process 360, and the solvent based cleaning fluid recirculation process thereby reducing the number of opportunities that the operator is exposed to the solvent based cleaning fluid 30.

In one embodiment of the present invention, the clean fluid device 8 of FIG. 2 further comprises a fluid heater 27 disposed between the pump 25 and the cleaning basket assembly 2 in the inlet line 26. The fluid heater 27 is coupled to the controller 5 of FIG. 7. The fluid heater 27 has the ability to increase the temperature of the solvent based cleaning fluid 30. The elevated temperature of the solvent based cleaning fluid 30 has the effect of improving the soil removal cleaning performance for some types of article and soiling combinations.

In another embodiment of the present invention the article cleaning apparatus 1000 of FIG. 1 is further configured to add a small quantity of water (in the range from about 1 percent to about 8 percent of the total weight of the solvent based cleaning fluid 30) and other cleaning agents to the rotating basket 14 to mix with the solvent based cleaning fluid 30 entering the cleaning basket assembly 2 through the inlet line 26. In one embodiment of the present invention, the cleaning basket assembly 2 of FIG. 8 further comprises a hot water inlet 175 and a cold-water inlet 180, both of which are coupled to a mixing valve 185. A basket conductivity cell 170 and a basket level detector 172 are disposed in the cleaning basket assembly 2, such that the basket conductivity cell 170 determines the conductivity of the fluid in the rotating basket 14 and the basket level detector 172 determines the level of the water based cleaning fluid 31 or the solvent based cleaning fluid 30 in the rotating basket 14. In one embodiment of the present invention, a dispenser 300 is disposed off a line that couples the mixing valve 185 to the basket support structure 12. Additionally, the operator adds the cleaning agents to the dispenser 300 and the subsequent action of the water running through the line coupling the mixing valve 185 to the basket support structure 12 entrains the cleaning agents that are disposed in the dispenser 300 into the water entering the rotating basket 14.

Figure 14:
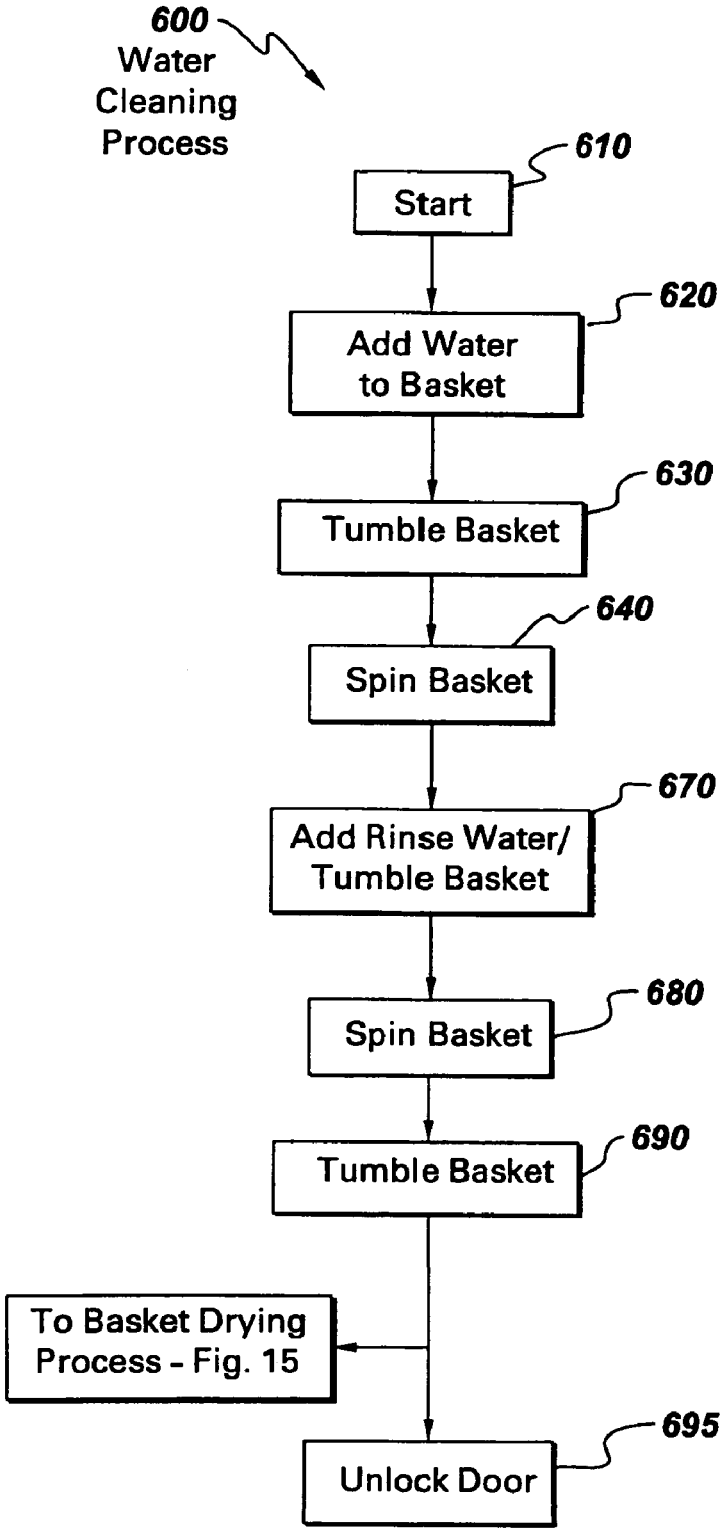
FIG. 14 is a flow diagram of a water cleaning process in accordance with one embodiment of the present invention.

In one embodiment of the present invention, the article cleaning apparatus 1000 of FIG. 1 is further configured to perform the water cleaning process 600 of FIG. 14 utilizing a water based cleaning fluid 31. In addition to the above-discussed components associated with monitoring and adding water to the rotating basket 14, a water drain line 270 connects to the drain conduit 70 upstream of the check valve 40. The water drain line 270 also connects to the suction side of the regeneration pump 115. A water drain valve 260 is disposed in the water drain line 270. The method of adding cleaning agents to the water in the rotating basket 14 is the same as discussed above.

Figure 10:
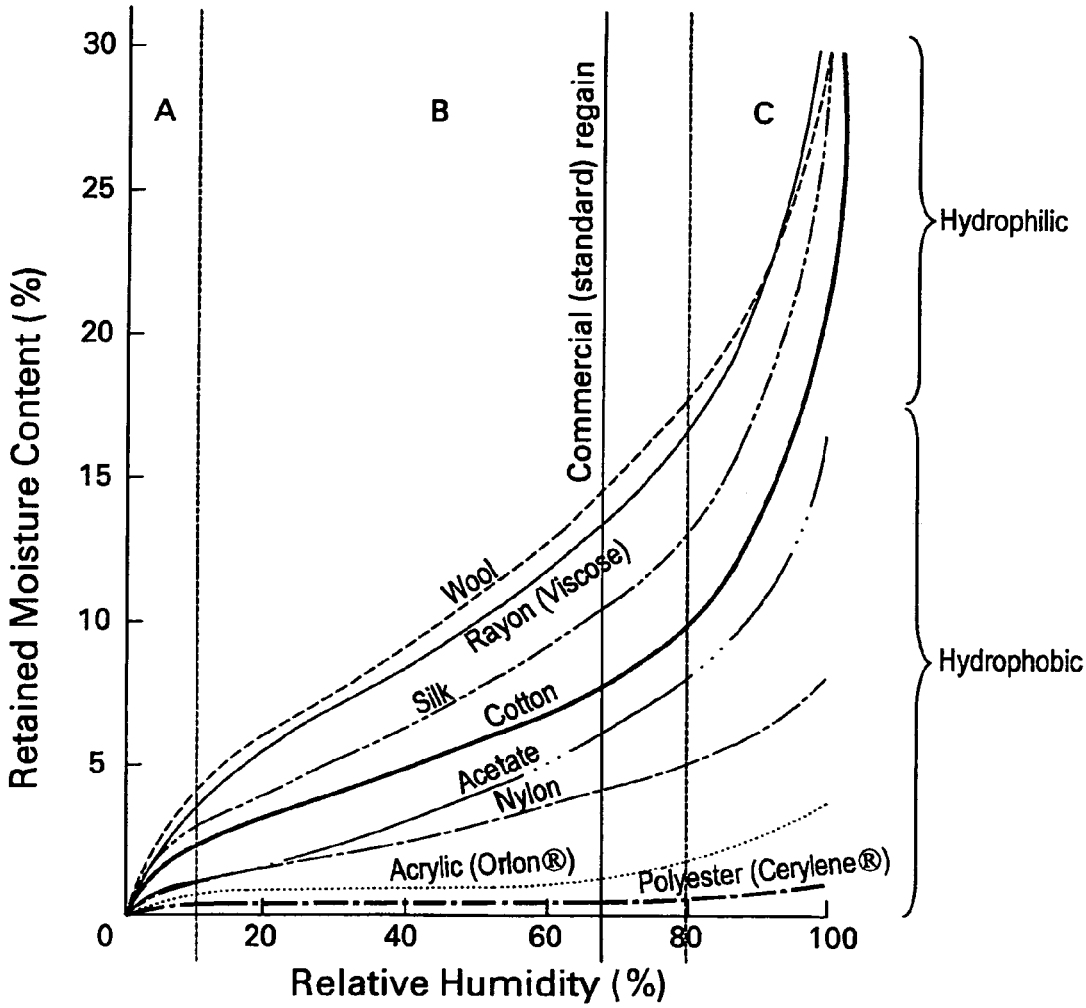
FIG. 10 is a plot of retained moisture content as a percentage of an article's weight versus the relative humidity.

A plot of retained moisture content as a percentage of an article's weight versus the relative humidity is provided in FIG. 10 for a variety of materials that are commonly used to comprise articles. As the fluid processing mechanism 4 of FIG. 2 contains a finite quantity of water removal capability, the controller 5 of FIG. 7 is configured to reduce the amount of water admitted to the fluid processing mechanism 4 of FIG. 2. The reduction of the retained moisture content is accomplished in a humidity sensing process 400 of FIG. 11 that is part of the solvent cleaning process 375.

In one embodiment of the present invention, a process selection 310 of FIG. 11 occurs at the operator interface 190 and provides inputs to the controller 5 of FIG. 7. The operator selects between the cleaning process 350 of FIG. 11 and a drying process 360. As used herein, the term, "drying process" refers to the drying of articles after completing the water based cleaning 600 of FIG. 14. When the operator selects the cleaning process 350 of FIG. 11, the operator then further chooses between performing either the solvent cleaning process 375 or the water cleaning process 600. In the present invention, the solvent cleaning process 375 of FIG. 11 is defined to include performing the humidity sensing process 400 and the subsequent solvent wash/dry process 500. Conversely, when the operator selects the drying process 360, a basket drying process 700 is performed. In one embodiment of the present invention, the operator has the option to select an additional solvent wash process as part of the solvent wash/dry process 500. The additional solvent wash process is typically used in conjunction with utilizing the solvent based cleaning fluid 30 that comprises cleaning agents. The additional solvent wash process typically improves the removal of the cleaning agents from the articles that remain after initially completing step 540 as detailed below. In another embodiment of the present invention, the operator has the option to select an additional rinse process as part of the water cleaning process 600. In another embodiment of the present invention, when the operator selects the drying process 360 the operator is provided with a further option of selecting from either the basket drying process 700 or a timed basket drying process 705.

Figure 12:
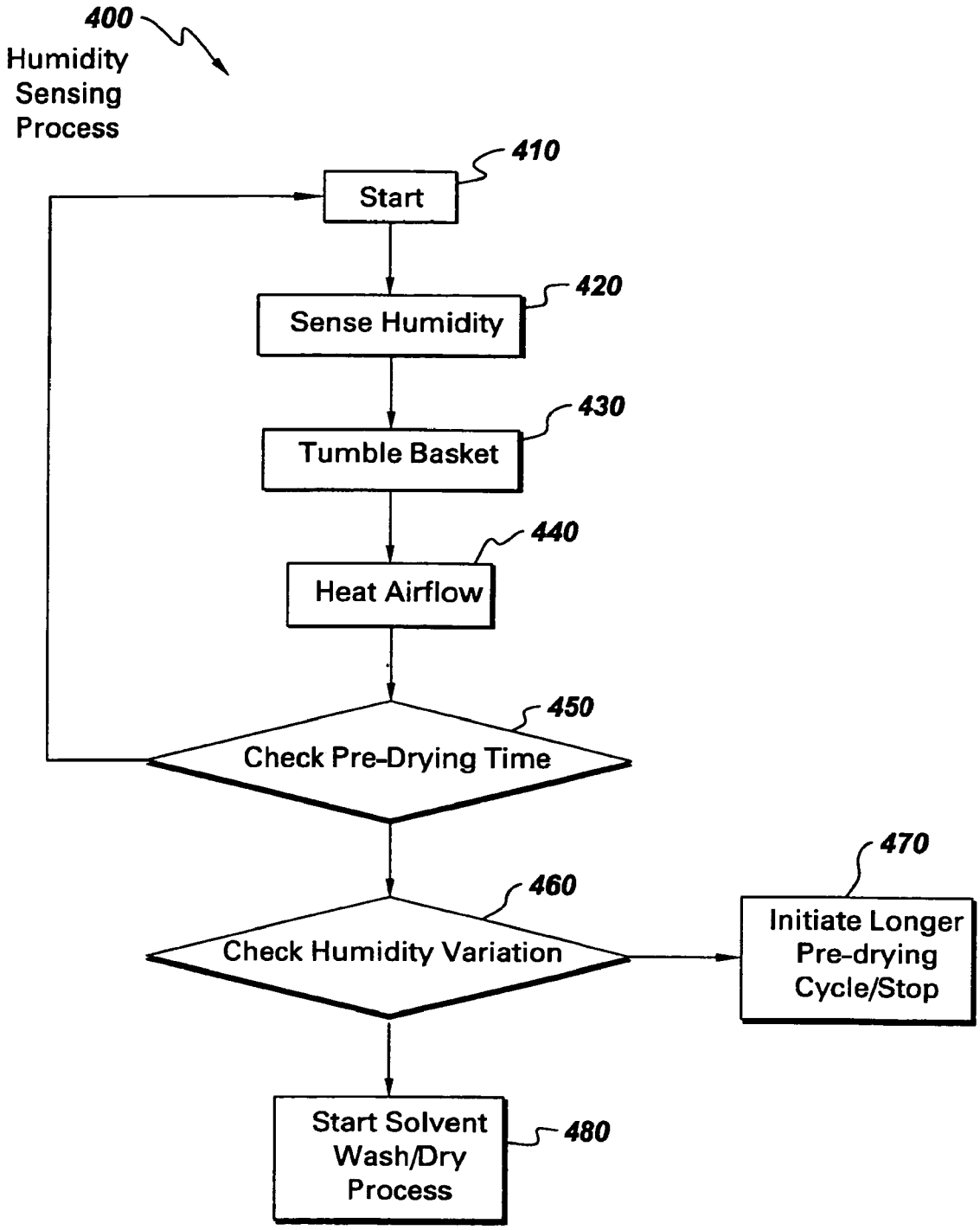
FIG. 12 is a flow diagram of a humidity sensing process in accordance with one embodiment of the present invention.

The start of the solvent based cleaning cycle 375 of FIG. 11 starts with the controller 5 of FIG. 7 sensing the humidity in the rotating basket 14 of FIG. 8 by initiating the humidity sensing process 400 of FIG. 12. The start 410 of the humidity sensing process 400 initially begins by verifying that the door lock 19 is locked. A starting humidity in the rotating basket 14 of FIG. 8 is determined in the sensing humidity step 410 of FIG. 12 by the basket humidity sensor 173. The controller 5 of FIG. 7 then tumbles the rotating basket 14 in step 430 of FIG. 12. The airflow 53 of FIG. 5 is heated and passed through the air management mechanism 1 and the cleaning basket assembly 2 while tumbling the rotating basket 14 for a predetermined pre-drying time in step 440 of FIG. 12. The moisture in the rotating basket 14 becomes vapor. The airflow 53 containing the vapor comes out of the rotating basket 14 through the holes 17 of FIG. 8 and then passes through the lint filter 60. The airflow 53 of FIG. 5 subsequently passes over the cooling coil 65 where the vapor condenses to form condensate. The rotating basket 14 is tumbled and the airflow 53 entering the cleaning basket assembly 2 is heated for the predetermined amount of time. The controller 5 of FIG. 7 then determines a finishing humidity in the rotating basket 14 of FIG. 8. If the controller 5 of FIG. 7 determines that the finishing humidity is too high, then the controller 5 of FIG. 7 sends a warning in step 470 of FIG. 12 to the operator at the display panel 200 indicating that it may take longer to complete the solvent cleaning process 375 and a longer humidity sensing process 400 is initiated.

After completing the humidity sensing process 400, the solvent wash/dry process 500 of FIG. 13 is typically executed. The following typical solvent wash/dry process 500 of FIG. 13 is utilized in one embodiment of the present invention. The following steps of the solvent wash/dry process 500 are provided for illustration and in no way implies any restriction to the present invention. The initial conditions at the start step 510 include reverifying that the door lock 19 of FIG. 8 is locked. The solvent based cleaning fluid 30 of FIG. 2 is added to the washer drum and rotating basket 14 of FIG. 8 as depicted in step 520 of FIG. 13 and as described in detail above. The rotating basket 14 of FIG. 8 is then tumbled as shown in step 530 of FIG. 13. After tumbling for a predetermined amount of time, the controller 5 of FIG. 7 opens the check valve 40, and the solvent based cleaning fluid 30 of FIG. 2 starts to drain from the washer drum and rotating basket 14 of FIG. 8. Substantially all of the remaining portion of the solvent based cleaning fluid 30 of FIG. 2 is spin extracted by spinning the rotating basket 14 in step 540 of FIG. 13. The solvent based cleaning fluid 30 is drained to the working tank 45 and subsequently the controller 5 of FIG. 7 shuts the check valve 40 of FIG. 2.

The solvent vapor pressure in the rotating basket 14 of FIG. 8 is determined in step 560 of FIG. 13. The controller 5 of FIG. 7 then tumbles the rotating basket 14 and raises the temperature of the airflow 53 of FIG. 5 in step 570 of FIG. 13. A substantial amount of the remaining portion of the solvent based cleaning fluid 30 and any liquid becomes vapor. The vapor flows from the rotating basket 14 through the lint filter 60 and passes over the cooling coil 65. The vapor condenses on the cooling coil 65 to form a condensate. The post-drying solvent vapor pressure in the rotating basket 14 of FIG. 8 is determined in step 580 of FIG. 13. The process steps of 560 through 580 FIG. 13 as detailed above are performed until the post-drying solvent vapor pressure in the rotating basket 14 of FIG. 8 reaches an acceptable level, at which point the controller 5 of FIG. 7 unlocks the basket door 15 in step 590 of FIG. 13. In another embodiment of the present invention, the operator selects the additional solvent wash process. The additional solvent wash process comprises completing step 520, step 530, and step 540 occurs after completing step 540 and before performing step 560, where the individual steps are as described above. In one embodiment of the present invention, the additional solvent wash process enhances the cleaning performance of especially soiled articles. In another embodiment of the present invention, the additional solvent wash process enhances the removal of cleaning agents. The operator selects the additional solvent wash process at the operator interface 190.

In one embodiment of the present invention the rotating basket 14 of FIG. 8 has a typical load range between about 0.9 kg and about 6.8 kg. The rotating basket 14 has a rotating basket capacity with a typical range between about 17 liters and about 133 liters, which is generally useful for performing laundering utilizing the solvent based cleaning fluid 30 of FIG. 2. The ratio of liters of solvent based cleaning fluid 30 per kg of articles in the laundry load is generally in a range from about 4.2 liters/kg to about 12.5 liters/kg. The corresponding total capacity of the solvent based cleaning fluid 30 per laundry load is generally in a range from about 3.8 liters (4.2 liters/kg times 0.9 kg) to about 85 liters (12.5 liters/kg times 6.8 kg), respectively. The total amount of solvent based cleaning fluid 30 in the article cleaning apparatus 1000 of FIG. 1 is from about 1.05 to about 2.0 times the amount of solvent based cleaning fluid 30 of FIG. 2 required per load. The total amount of solvent based cleaning fluid 30 equates to a range from about 4 liters (3.8 liters times 1.05) to about 170 liters (85 liters times 2), which corresponds to a typical ratio of the capacity of the solvent based cleaning fluid 30 to laundry load ranges from about 4.4 liters/kg (4 liters/0.9 kg) to about 25 liters/kg (170 liters/6.8 kg), respectively.

In another embodiment, the typical amount of articles in a laundry load range from about 2.7 kg to about 5.4 kg. The corresponding total capacity of the solvent based cleaning fluid 30 per laundry load is generally in a range from about 11.3 liters (4.2 liters/kg times 2.7 kg) to about 67.5 liters (12.5 liters/kg times 5.4 kg). The total amount of solvent based cleaning fluid 30 in the article cleaning apparatus 1000 of FIG. 1 is from about 1.05 to about 2.0 times the amount of solvent based cleaning fluid 30 of FIG. 2 required per load. The total amount of solvent based cleaning fluid 30 equates to a range from about 11.9 liters (11.3 liters times 1.05) to about 135 liters (67.5 liters times 2).

In another embodiment, the ratio of liters of solvent based cleaning fluid 30 of FIG. 2 to kg of articles is from about 6.7 liters/kg to about 8.3 liters/kg. When the load capacity is in a range from about 0.9 kg to about 6.8 kg, the corresponding total capacity of the solvent based cleaning fluid 30 per laundry load is generally in a range from about 6.0 liters (6.7 liters/kg times 0.9 kg) to about 56.4 liters (8.3 liters/kg times 6.8 kg), respectively. When the load capacity is in a range from about 2.7 kg to about 5.4 kg, the corresponding total capacity of the solvent based cleaning fluid 30 per laundry load is generally in a range from about 18.1 liters (6.7 liters/kg times 2.7 kg) to about 44.8 liters (8.3 liters/kg times 5.4 kg), respectively. The total amount of solvent based cleaning fluid 30 in the article cleaning apparatus 1000 of FIG. 1 is from about 1.05 to about 2.0 times the amount of solvent based cleaning fluid 30 of FIG. 2 required per load. The total amount of solvent based cleaning fluid 30 equates to a range from about 6.3 liters (6.0 liters times 1.05) to about 112.8 liters (56.4 liters times 2).

In order to reduce the total capacity of the solvent based cleaning fluid 30 in the article cleaning apparatus 1000 of FIG. 1, the cleaning fluid processing is performed on-line and the processing is synchronized with the solvent wash/dry process 500 of FIG. 13. Processing the solvent based cleaning fluid 30 of FIG. 2 on-line typically provides sufficient solvent based cleaning fluid 30 in the clean storage tank 35 to perform a subsequent solvent cleaning process 350 of FIG. 11 after completing the previous solvent cleaning process 350. The clean storage tank 35 of FIG. 2 typically has a sufficient capacity of the solvent based cleaning fluid 30 to make up for any solvent based cleaning fluid 30 that is held up in the fluid regeneration device 7, in the working fluid device 6, and retention in the "dried" articles. The regeneration cartridge 141 is capable of replenishing the amount of solvent based cleaning fluid 30 that is retained in the "dried" articles. In one embodiment of the present invention, the typical solvent capacity of the clean storage tank 35 is from about 10.4 liters/kg to about 12.5 liters/kg when the load capacity ranges from about 2.7 kg to about 5.4 kg. The clean storage tank 35 has a corresponding typical range from about 28.1 liters to about 67.5 liters. Therefore, the clean storage tank 35 of the present invention typically needs only about 36% (67.5 liter/190 liter) of the capacity of the about 190 liter clean storage tank found in typical commercial chemical fluid dry cleaning machines. In one embodiment of the present invention, the typical solvent capacity of the clean storage tank 35 is from about 10.4 liters/kg to about 12.5 liters/kg when the load capacity ranges from about 0.9 kg to about 6.8 kg. The clean storage tank 35 has a corresponding typical range from about 9.4 liters to about 85 liters. Therefore, the clean storage tank 35 of the present invention typically needs only about 45% (85 liter/190 liter) of the capacity of the about 190 liter storage tank found in typical commercial chemical fluid dry cleaning machines. The above comparison of storage tank capacity typical range from about 9.4 liters to about 85 liters for the present invention compares favorably to the range of the storage tank capacity of from about 190 liters to about 1325 liters for typical commercial chemical fluid dry cleaning machines.

In another embodiment of the present invention, the solvent wash/dry process 500 adds water to the solvent based cleaning fluid 30 of FIG. 2 in the rotating basket 14, where the maximum amount of water added is in the range from about 1 percent to about 8 percent of the total weight of the solvent based cleaning fluid 30 that is in the rotating basket 14. Adding the water to the solvent based cleaning fluid 30 that is in the rotating basket 14 is performed as described above. In another embodiment of the present invention, the solvent wash/dry process 500 adds water and cleaning agents to the solvent based cleaning fluid 30 of FIG. 2 in the rotating basket 14, where the maximum amount of water added does not exceed a maximum of about 8 percent of the total weight of the solvent based cleaning fluid 30 that is in the rotating basket 14. Adding the water and the cleaning agents to the solvent based cleaning fluid 30 that is in the rotating basket 14 is performed as described above.

Steps 560 of FIG. 13 through 580 in the solvent wash/dry process 500 require a typical range from about 15 minutes to about 60 minutes for the typical laundry load, which ranges from about 0.9 kg of articles to about 6.8 kg of articles. The sensible heat required to dry the clothes, which is the principle source of total electrical power the machine requires, is in a range between about 430 watts to about 6300 watts. As used herein, the term, "sensible heat" is defined to be the total amount of heat added by the combination of the heater 55 and auxiliary heater 158 (if installed). In another embodiment, the drying time is between about 20 and about 60 minutes with the typical laundry load range between about 2.7 kg of articles and about 5.4 kg of articles. In this case, the sensible heat required to dry the clothes is in a range between about 1300 watts and about 5200 watts. In each of these cases, the power is easily handled on a household circuit with a maximum voltage of about 240V and a maximum amp rating of about 30 amps. In some embodiments, the article cleaning apparatus 1000 of FIG. 1 is configured to run on about 220V service in an about 20-amp circuit, about 220V service in an about 30-amp circuit, and about 110V service and in a circuit having a amperage range from about 15 amps to about 20 amps. All of these circuit types are typically available in homes for currently available cooking and drying appliances; therefore, presenting no additional installation difficulties.

The controller 5 of FIG. 7 controls the water cleaning process 600 of FIG. 14. The controller 5 of FIG. 7 is configured to reduce the opportunity for introducing large amounts of water into the working tank 45 of FIG. 2 as discussed herein. In the present invention, a fluid in the rotating basket 14 is defined to contain a "large amount of water" when the fluid comprises greater than about 10% water by weight. The water cleaning process 600 of FIG. 14 is provided to illustrate a series of steps used in one embodiment of the present invention and in no way implies any limitation to the water cleaning process 600 utilized in the present invention.

The water cleaning process 600 begins with the initial conditions of the cleaning agents loaded into the dispenser 300, and the door lock 19 engaged and the door lock sensor 18 verifying that the basket door 15 in the locked position at the start step 610 of FIG. 14. Water and cleaning agents are added to the washer drum and rotating basket 14 to produce the water based cleaning fluid 31 of FIG. 9 in step 620. The water may be hot, cold or a mixture as detailed above. The rotating basket 14 is tumbled in step 630 of FIG. 14. Substantially all of the water based cleaning fluid 31 of FIG. 9 is spin extracted by rotating from the rotating basket 14 of FIG. 2 in step 640 of FIG. 14. The controller 5 of FIG. 7 opens the water drain valve 260 of FIG. 2 and operates the regeneration pump 115 as necessary to drain the rotating basket 14 during the spin step 640, when the basket conductivity cell 170 of FIG. 8 detects that the water based cleaning fluid 31 of FIG. 9 in the rotating basket 14 comprises greater than about 10% water by weight. The controller 5 of FIG. 7 closes the water drain valve 260 of FIG. 2 after removing the water based cleaning fluid 31 of FIG. 9 from the washer drum and rotating basket 14 of FIG. 2 after completing the spin basket step 640.

Rinse water is then added to the washer drum and rotating basket 14 of FIG. 8 and the rotating basket 14 is tumbled in step 670 of FIG. 14. The temperature of the rinse water is determined by the controller 5 of FIG. 7 in conjunction with the mixing valve 185 of FIG. 8. Substantially all of the remaining amount of rinse water is spin extracted by spinning the rotating basket 14 in step 680 of FIG. 14. The rinse water is removed as described above. The rotating basket 14 is tumbled in step 690 of FIG. 14. The basket door 15 of FIG. 8 is then unlocked in step 695 of FIG. 14.

In another embodiment of the present invention, the operator selects an additional rinse process. The additional rinse process once again performs step 670, step 680, and step 690. The additional rinse process occurs after step 690 and before the basket door 15 is unlocked in step 695. The additional rinse process assists in removing the entrained cleaning agents that are not removed during steps 670, 680, and 690. The additional rinse process is especially useful when using soft water. As used herein, the term "soft water" is defined as comprising less than about 10 grains of hardness per about 3.8 liters of water.

Figure 15:
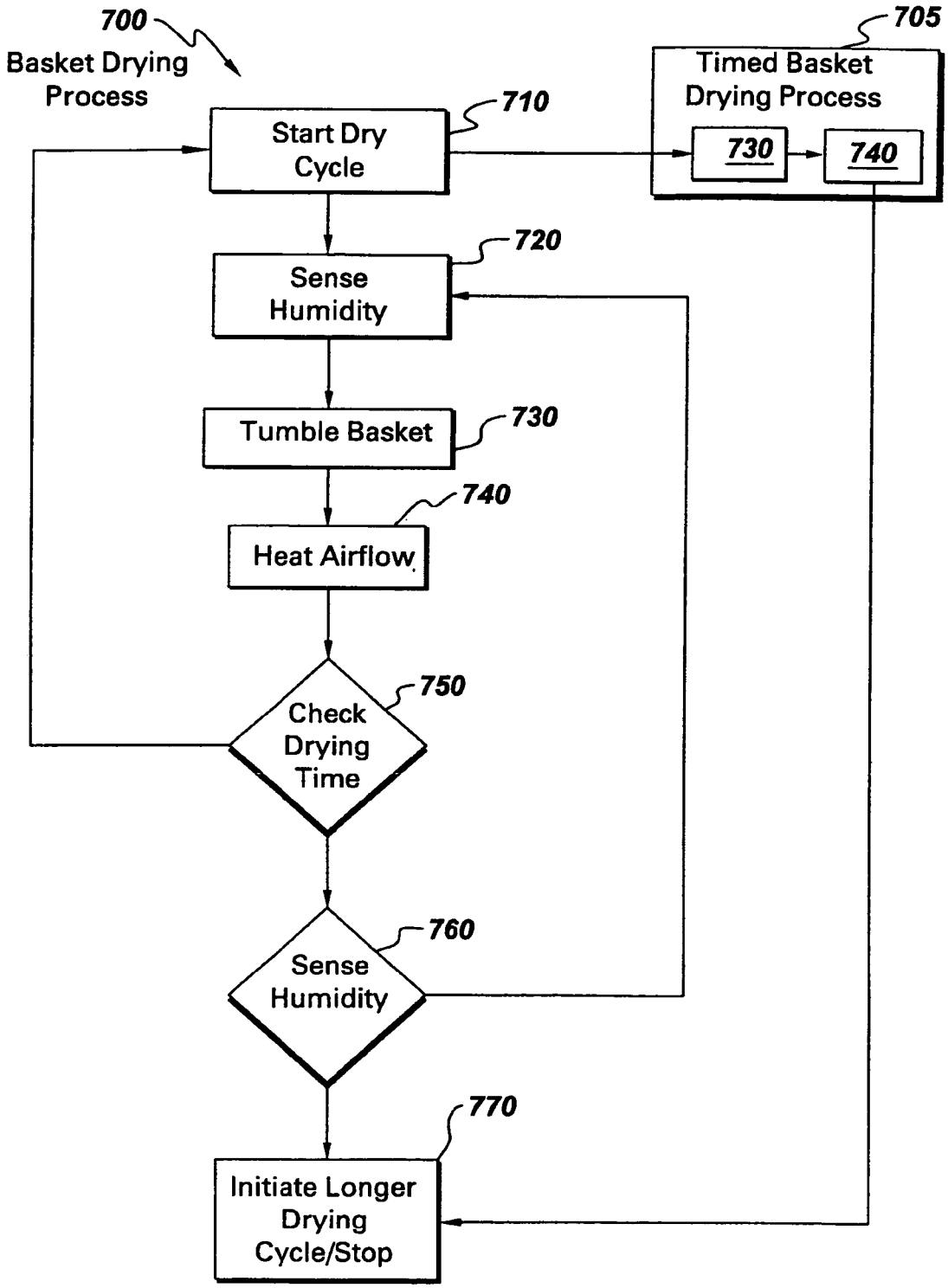
FIG. 15 is a flow diagram of a basket drying process in accordance with one embodiment of the present invention.

In another embodiment of the present invention, the article cleaning apparatus 1000 of FIG. 1 is configured to perform the basket drying process 700 of FIG. 15. The basket drying process 700 of FIG. 15 is provided to illustrate the basket drying process 700 used in one embodiment of the present invention and in no way implies any limitation to the basket drying process 700 of the present invention. The basket drying process 700 begins with the initial conditions of the basket door 15 locked, and the door lock sensor 18 verifying the basket door 15 locked at the start step 710 of FIG. 15. The basket drying process 700 initially begins by performing a sensing humidity step 720 to determine a start humidity, a tumble basket step 730 and heat airflow step 740 similar to that described above in steps 420, 430, and 440, respectively. After tumbling and heating the airflow 53 for a predetermined post-water wash drying time, the controller 5 of FIG. 7 determines a final humidity in the rotating basket 14 of FIG. 8 in step 760. When the controller 5 of FIG. 7 determines that the final humidity is too high, then the controller 5 initiates a longer drying sequence in step 760 by re-performing steps 730 through 760. When the final humidity is acceptable, the controller 5 of FIG. 7 stops the basket drying process 700 of FIG. 15 in step 770, and unlocks the basket door 15 of FIG. 8 in step 780 of FIG. 15.

In another embodiment of the present invention, a timed basket drying process 705 of FIG. 11 is available to the operator at the operator interface 190. The timed basket drying process 705 comprises the steps of starting the drying cycle 710 of FIG. 15 by setting the predetermined amount of drying time, tumbling the rotating basket 14 in step 730, heating the airflow 53 in step 740, and stopping the timed basket drying process in step 770 when predetermined amount of drying time is accomplished. The controller 5 of FIG. 7 unlocks the basket door 15 of FIG. 8 in step 780 of FIG. 15.

Figure 19:
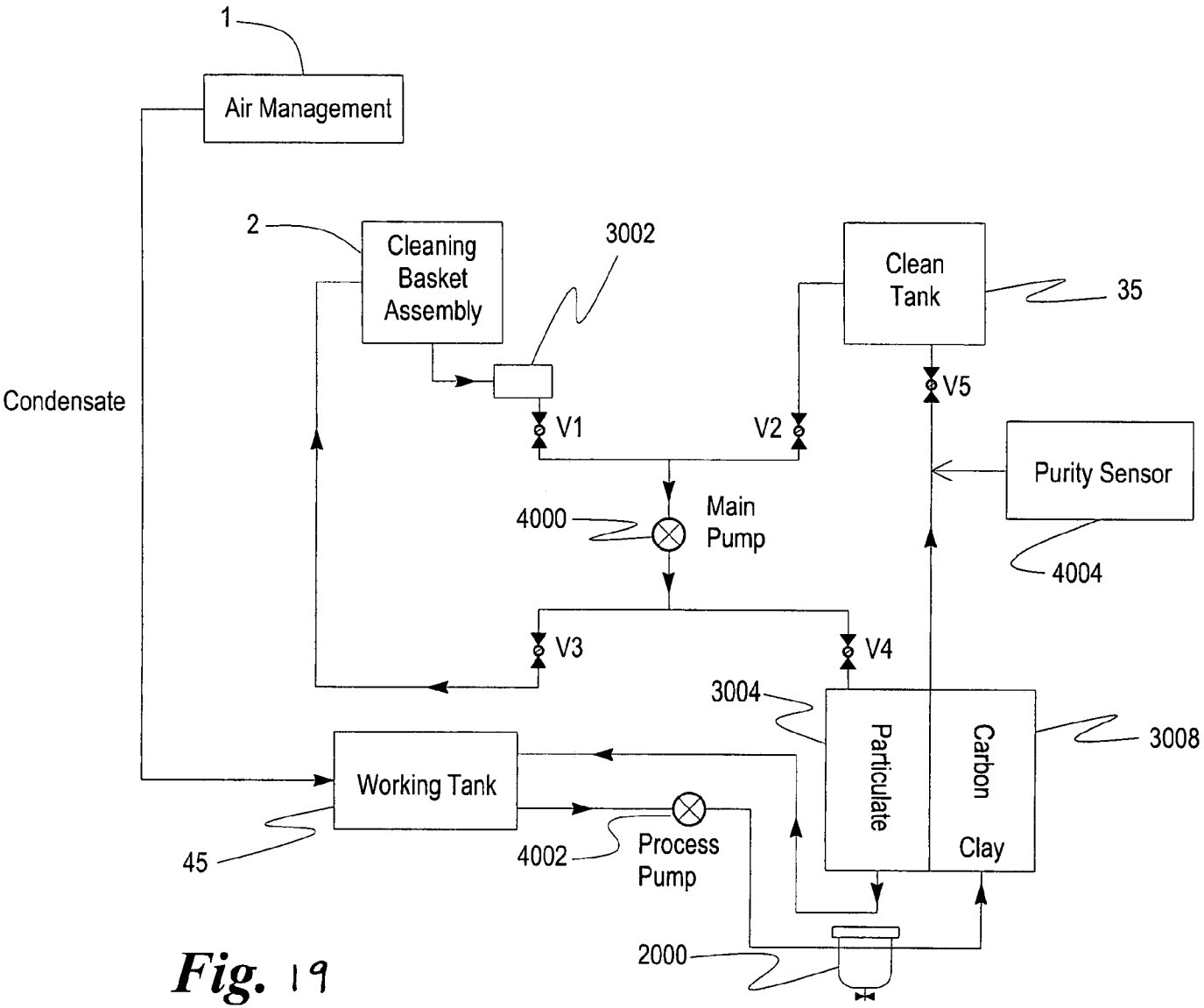
FIG. 19 is a schematic diagram illustrating an improved solvent purification system in accordance with another embodiment of the present invention.

As was mentioned above in the context of article cleaning apparatus 1000, it may be generally desirable to avoid the unnecessary introduction of water into the solvent based cleaning fluid 30 such as, e.g., into working tank 45 during the solvent wash/dry process 500. Additionally, it is also generally desirable to reduce the possibility that the solvent based cleaning fluid 30 is accidentally pumped out of the article cleaning apparatus 1000. One determining factor in whether both operating aspects are achieved is associated with how effective the solvent recovery process is at separating and removing water from the solvent based cleaning fluid Reference is now drawn to FIG. 19 wherein a schematic diagram illustrating an improved solvent purification arrangement according to one embodiment of the present invention is illustrated. With the exception of certain components to be described below, the solvent purification arrangement depicted in FIG. 19 is intended to represent a simplified view of article cleaning apparatus 1000 of FIG. 2. It has been advantageously recognized herein that the solvent phase and the water phase of the cleaning fluid condensate are substantially separated at the time of formation within air management mechanism 1 during the drying cycle. Thus, in accordance with one embodiment of the present invention, and as illustrated in FIG. 19, air management mechanism 1 may be equipped to drain cleaning fluid condensate produced from the washer drum and rotating basket 14 during the drying cycle directly into the working tank 45. As such, subsequent mixing of the water and solvent phases that would otherwise be caused by passage of the condensate through the high shear environment of a high mixing pump, for example, can be avoided. Since the solvent phase and water phase condense and fall directly into the working tank 45, their separation is rapid and complete. In turn, a faster and more complete phase separation of the solvent phase and the water phase results in a decreased cycle time and reduced loss of solvent when discarding the water phase.

In accordance with the illustrated embodiment of FIG. 19, a main pump 4000 is provided to pump the cleaning fluid from the rotating basket 14 and washer drum (illustrated as cleaning basket assembly 2) to the working tank 45. In one embodiment of the present invention, main pump 4000 represents a low mixing pump. As used herein, the term "low mixing pump" is defined for illustrative purposes and without limitation as a pump which imparts small amount of turbulence to the water and solvent phases of the cleaning fluid. The amount of turbulence in a fluid generally depends on the velocity and general characteristics of the fluid. For example, if the layers of a fluid slide easily over one another, the fluid is said to exhibit laminar flow and has little turbulence. If the velocity is high enough, the local flow of the fluid may include circular currents that impede the sliding of the layers of the fluid. The turbulence imparted upon a fluid by a device such as a pump generally depends not only upon characteristics of the fluid, but also characteristics of the pump itself.

The Reynolds number is a dimensionless quantity that serves as an indicator for the type of flow a fluid will exhibit. By extension, the Reynolds number (hereinafter referred to as the "mixing Reynolds number") may be used to quantify the amount of turbulence caused by a given centrifugal pump in a particular fluid. In accordance with one embodiment of the present invention, the mixing Reynolds number NRe can be represented by equation 1 as follows:

$$N_{Re} = \frac{D^2 N \rho}{\mu} \qquad \text{(Eq. 1)}$$

where N is the rotational speed of the impeller;

D represents the diameter of the pump impeller;

ρ represents the fluid density; and

μ represents the fluid viscosity.

Accordingly, by calculating the mixing Reynolds number of Eq. 1 for each pump to be evaluated, a relative comparison can be made with respect to mixing characteristics of a given pump for a particular fluid. For example, the following table (Table 1) illustrates particular specifications of a high mixing pump (pump model number SA55CXFJN-3542 commercially available from Jabsco US., hereinafter referred to as a "Jabsco pump"), and a low mixing pump (pump model number DPO 40-001 commercially available from Hanning Elektro-Werke GmbH & Co. KG, hereinafter referred to as a "Hanning pump"), as well as their corresponding mixing Reynolds numbers as calculated based upon decamethylcyclopentasiloxane (also commonly referred to as D5) as the fluid to be pumped.

TABLE 1

| Specifications | Jabsco (115 v; 432 w; 60 Hz) | Hanning (115 v; 432 w; 60 Hz) |
|---|---|---|
| Impeller Tip speed (pi*DN) | 4.7 | 3.52 |
| N = rpm, min-1 | 1750 | 3500 |
| N = rps, sec-1 | 29.2 | 58.3 |
| D = Impeller Diameter (m) | .0513 | .0192 |
| p = Fluid density (kg/m$^3$) for D5 | 950 | 950 |
| μ = Fluid viscosity (kg/m-s) for D5 | .0038 | .0038 |
| $N_{RE}$ | 19,176 | 5,393 |

In one embodiment of the present invention, the main pump 4000 is a low mixing pump that imparts a fluid flow that may be characterized by a Reynold's number, (e.g., as calculated from impeller dimensions and rates) of about 15,000 or less, and more preferably about 10,000 or less. In one embodiment, the main pump 4000 may be characterized by a Reynold's number of about 5,400 as illustrated in Table 1. A low mixing pump such as the main pump 4000 may have an operating speed of about 3500 rpm or less, and power output of about 400 watts or less. These low mixing operating parameters for the main pump 4000 result in the cleaning fluid being substantially less mixed than other pumps that are relatively high mixing. For the purpose of comparison, a typical high mixing pump, such as the Jabsco pump of TABLE 1, may operate at about 1750 rpm, with a power output of 432 watts, and be characterized by a resultant Reynolds number of about 19,000.

Contrary to the logical inference that a high speed pump might facilitate more rapid purification of cleaning fluid than would a low speed pump due to the increased fluid handling capabilities, it has been recognized herein that the high mixing pump actually acts to increase solvent purification speed. In particular, it has been recognized herein that as with the cleaning fluid condensate described above, the state of the cleaning fluid as it is drained from the basket and washer drum has a solvent phase which is substantially separate from a water phase. Furthermore, use of a high speed pump that might otherwise be employed to pump cleaning fluid from a cleaning basket assembly (such as cleaning basket assembly 2) to an adsorption filter (such as adsorption filter 3008) causes such high mixing and shear to be imparted to the cleaning fluid that the solvent phase and water phase are forced to completely mix. As a result of this mixing, it takes the water separator 2000 substantially more time to separate the water and solvent phases since the water separator 2000 needs to wait for the water phase to completely settle such that it is relatively free of residual solvent.

By using a low mixing pump as the main pump 4000 rather than a high mixing pump to pump the cleaning fluid from the rotating basket 14 and washer drum to the working tank 45, it is possible to impart considerably less shear and mixing to the cleaning fluid drained from the rotating basket 14 and washer drum than would otherwise be possible. As a result, the cleaning fluid within working tank 45 can achieve and maintain substantial phase separation between the solvent phase and the water phase. As such, the inclusion of the low mixing main pump 4000 within cleaning apparatus 1000 allows for more rapid purification of cleaning fluid thereby reducing solvent losses that might otherwise occur during discarding of the water phase (e.g., if there is not complete phase separation, then some of the solvent is discarded with the water).

In one embodiment, the process pump 4002 (e.g. as shown in FIG. 19) pumps the cleaning fluid from the working tank 45 to the water separator 2000. In contrast to the low mixing main pump 4000, the process pump 4002 is a small positive displacement gear pump that does not contribute significantly to liquid phase mixing. Pumping occurs at low flow rates, e.g. 650 ml/min from the working tank through the fluid separator and the carbon adsorption bed and finally into the clean tank as shown in FIG. 19. Low flow rates are used during this process to ensure sufficient time for the carbon to adsorb the soluble impurities from the solvent. In one embodiment, the fluid separation process is performed concurrently with the drying step. An illustrative, example of a pump suitable for use as the process pump 4002 is the commercially available Greylor gear pump, model number PQ-12 DC.

FIG. 19 further illustrates a purity sensor 4004. In the illustrated embodiment, the purity sensor 4004 is located downstream of the adsorption filter 3008 and is configured to monitor the purity of the cleaning fluid passing the adsorption filter to the clean storage tank 35. In this embodiment, the purity sensor 4004 generally comprises a flow cell, a UV light source, and a UV detector. In addition, the UV sensor 4004 may use a band pass filter on either side of the flow cell to produce the desired wavelength for the sensor. In this embodiment, a specific wavelength (e.g., 223 nm or 274 nm) may be preferable, but a relatively narrow wave band (e.g., 220-230 nm) will also work. Other examples of a purity sensor that are suitable for use in this invention include an optical turbidity sensor 140 shown in FIG. 2.

In operation, the purity sensor 4004 monitors the cleaning fluid passing the adsorption filter 3008 to the clean storage tank 35 for impurities that may not have been retained by the filter. Impurities typically pass through the adsorption filter 3008 when it becomes saturated. Generally, since adsorbent in the adsorption filter 3008 has a limited capacity to remove soluble dirt, the adsorbent should be exchanged for fresh adsorbent when saturated in order to maintain filter performance levels. When soil levels reach a predetermined and sufficiently high level then the purity sensor 4004 indicates (e.g., by an indicator light) that the adsorption bed is saturated and should be replaced. Because fatty acids and esters are prevalent in dirty solvent, their concentration can be measured with an optical photocell in the UV range of 200-350 nm, which is responsive to the carbonyl functionality of the acids and esters at an intensity proportional to the concentration of soluble dirt present. With this configuration, the purity sensor 4004 provides real time information concerning the adsorption efficiency of the adsorption bed by comparing the concentration of the soluble dirt leaving the bed to a stored reference of clean solvent.

FIG. 20 illustrates an exemplary process flow for performing recovery and purification of dirty solvent using the configuration shown in FIG. 19. After washing the clothes in the cleaning basket assembly 2, the cleaning fluid is drained from the rotating basket 14 and washer drum at block 5000. The cleaning fluid then passes through the coarse filter 3002 (e.g. the lint trap) at block 5002. The course filter removes lint or fibers that are released from the articles during the wash and remain in the contaminated cleaning fluid upon draining of the basket and washer drum. The cleaning fluid then passes through the valve V1 into the low mixing main pump 4000, which pumps the cleaning fluid with low shear through valve V4 (block 5004). The clean fluid then passes through the particulate filter 3004 at block 5006. The particulate filter generally includes a finer mesh than that of the course filter and removes additional particulates of a smaller size from the cleaning fluid. After passing through the particulate filter 3004, the cleaning fluid enters the working tank 45 at block 5008.

The purification process may continue immediately upon receiving fluid into the working tank 45, or in an alternative embodiment, the cleaning fluid may be stored in the working tank 45 for later purification. In either embodiment, the process pump 4002 pumps the cleaning fluid from the working tank to the water separator 2000 at block 5010. The water separator 2000 separates the solvent phase from the aqueous phase at block 5012 and the adsorption filter removes impurities from the solvent phase at block 5014. The purity sensor 4004 monitors solvent purity at block 5016 before the solvent enters the clean tank through valve V5 at block 5018. The solvent is now ready for the next wash cycle. When it is time for the next cycle, the solvent passes through the valve V2 into the low mixing main pump 4000, which recirculates the solvent through valve V3 to fill the cleaning basket and washer drum for the next wash cycle.

Figure 16:
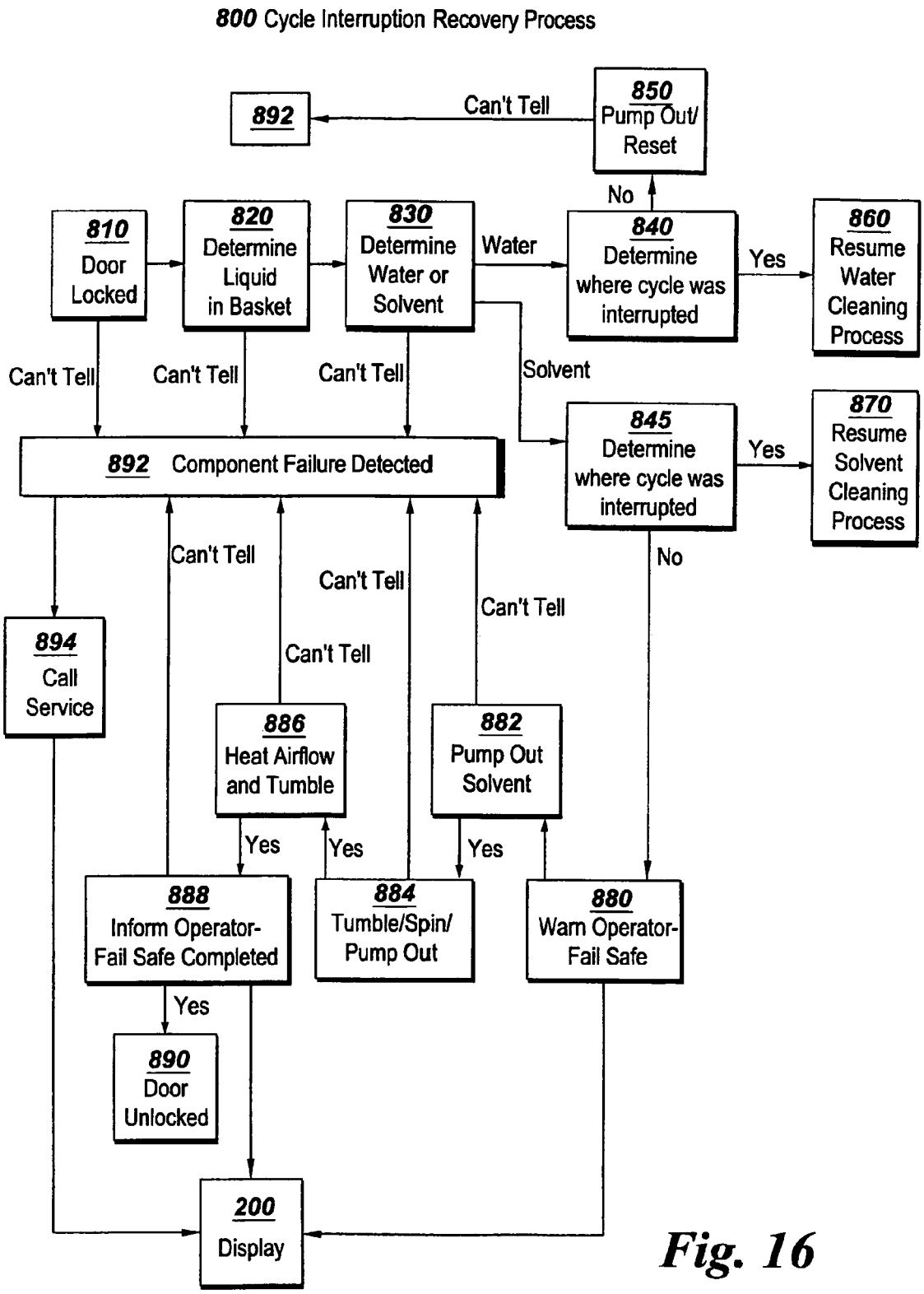
FIG. 16 is a flow diagram of a cycle interruption recovery process in accordance with one embodiment of the present invention.

In a further effort to avoid the unnecessary introduction of water into the solvent based cleaning fluid and to reduce the possibility that the solvent based cleaning fluid might be accidentally pumped out of the article cleaning apparatus 1000, a cleaning cycle interruption recovery process will now be described. For example, if the solvent cleaning process 375 of FIG. 11 or the water cleaning process 600 is interrupted by either the operator or a loss of electrical power, the controller 5 is equipped to perform a novel cycle interruption recovery process FIG. 16 is a flow diagram of a cycle interruption recovery process 800 in accordance with one embodiment of the present invention The cycle interruption recovery process 800 operates a series of logical sequence options to control the subsequent operation of the article cleaning apparatus 1000 of FIG. 1. The logical sequence options include completing the appropriate cleaning cycle, completing a fail-safe process, or informing the operator to call service.

In one embodiment of the present invention, the cycle interruption recovery process 800 starts by verifying the locked status of door lock 19 of FIG. 8 via the door lock sensor 18 in step 810 of FIG. 16. If the door lock sensor 18 of FIG. 8 is determined to be non-operational in the component failure detected step 892 of FIG. 16, then a call service message is generated in step 894, which is then sent to the display 200. Conversely, if the controller 5 of FIG. 7 does verify that the door lock 19 of FIG. 8 is locked in step 810 of FIG. 16, then the basket level detector 172 of FIG. 8 determines if there is liquid in the rotating basket 14 in step 820 of FIG. 16. If the controller 5 cannot tell if the basket level detector 172 is operational, then the component failure detected step 892 of FIG. 16 generates the call service message in step 894. If liquid is detected in step 820 of FIG. 16 then the basket conductivity cell 170 of FIG. 8 determines whether the liquid is the solvent based cleaning fluid 30 or the water based cleaning fluid 31 in step 830 of FIG. 16. Siloxane is non-conductive; therefore, the basket conductivity cell 170 of FIG. 8 typically provides a conductivity measurement of the liquid in the article cleaning apparatus 1000. If the controller 5 cannot tell if the basket conductivity cell 170 of FIG. 8 is operational, then the component failure detected step 892 of FIG. 16 generates a call service message in step 894.

If the basket conductivity cell 170 of FIG. 8 detects that the fluid in the rotating basket 14 comprises greater than about 10% water, then the fluid is defined to be the water based cleaning fluid 31. If the fluid in the rotating basket 14 is defined to be the water based cleaning fluid 31, then a determination of where the interruption occurred in the water cleaning process 600 is performed in step 840. In step 840, if the controller 5 of FIG. 7 has a memory of where the water cleaning process interruption occurred, then the water cleaning process 600 resumes as depicted in step 860. If the controller 5 in step 840 of FIG. 16 cannot remember where the water cleaning process interruption occurred, then the water based cleaning fluid 31 is pumped out and the cleaning process 350 of FIG. 11 is reset in step 850 of FIG. 16. If the controller 5 in step 850 of FIG. 16 cannot tell if the components required to perform step 850 are available, then the component failure detected step 892 generates the call service message in step 894.

If the basket conductivity cell 170 of FIG. 8 detects less than about 10% water in the liquid in the rotating basket 14, then the liquid is defined to be the solvent based cleaning fluid 30. If the liquid is defined to be the solvent based cleaning fluid 30, then a determination of where the interruption occurred in the solvent cleaning process 375 is performed in step 845. In step 845, if the controller 5 of FIG. 7 has a memory of where the solvent cleaning process interruption occurred, then the solvent cleaning process 375 resumes as depicted in step 870. If the controller 5 of FIG. 7 in step 845 of FIG. 16 cannot determine where the interruption occurred in the solvent cleaning process 375 of FIG. 11, then a warn operator fail-safe message is generated in step 880, which is then set to the display 200 of FIG. 9.

After generating the warn operator fail-safe message in step 880 of FIG. 16, the solvent based cleaning fluid 30 of FIG. 2 is pumped out in step 882 of FIG. 16. Subsequently the rotating basket 14 of FIG. 8 is tumbled and rotated to spin extract substantially all of the remaining portion of the solvent based cleaning fluid 30 of FIG. 2 from the rotating basket 14 in step 884 of FIG. 16. The airflow 53 is then heated while tumbling the rotating basket 14 of FIG. 8 in step 886 of FIG. 16. The operator is informed that the fail-safe is completed in step 888, and the fail-safe completed message is sent to the display 200 of FIG. 9, and the basket door 15 of FIG. 8 is unlocked in step 890 of FIG. 16. If it is determined that the components required to operate each of the steps 882, 884, 886, and 888 are non-operational, then the component failure detected step 892 of FIG. 16 generates the call service message in step 894.

The cycle interruption recovery process 800 of FIG. 16 is provided to illustrate the cycle interruption recovery process used by article cleaning apparatus 1000 in accordance with one embodiment of the present invention. The cycle interruption recovery process is not intended to be limited solely to the illustrated embodiment.

The foregoing description of several embodiments of the article cleaning apparatus 1000 and the method of using the article cleaning apparatus 1000 of the present invention has been presented for purposes of illustration. Although the invention has been described and illustrated in detail, it is to be clearly understood that the same is intended by way of illustration and example only and is not to be taken by way of limitation. Obviously many modifications and variations of the present invention are possible in light of the above teaching. Accordingly, the spirit and scope of the present invention are to be limited only by the terms of the appended claims.

What is claimed is:

1. A dry cleaning device, comprising:

a washer drum;

a cleaning basket disposed in the washer drum and configured to receive articles and a solvent based cleaning fluid;

a working tank configured to receive the solvent based cleaning fluid used in the washer drum and cleaning basket;

an air management mechanism configured to drain cleaning fluid condensate produced from the washer drum and cleaning basket directly into the working tank; and a low mixing pump configured to pump the solvent based cleaning fluid from the cleaning basket to the working tank, the low mixing pump characterized by a Reynolds number of about 15,000 or less, wherein the Reynolds number is determined as a function of one or more properties associated with an impeller of the low mixing pump, and wherein the low mixing pump is coupled to the cleaning basket via an inlet line and is coupled to the air management mechanism via a cooling coil wash down tubing.

2. The dry cleaning device according to claim 1, wherein the low mixing pump is characterized by a Reynolds number of about 6,000 or less.

3. The dry cleaning device according to claim 1, wherein the Reynolds number is represented by the equation $$N_{Re} = \frac{D^2 N \rho}{\mu},$$

where D is the diameter of the impeller, N is the solvent based cleaning fluid velocity, ρ is the solvent based cleaning fluid density, and μ is the solvent based cleaning fluid viscosity.

4. The dry cleaning device according to claim 1, further comprising a lint filter configured to remove lint from the solvent based cleaning fluid drained from the washer drum and cleaning basket to the low mixing pump.

5. The dry cleaning device according to claim 1, further comprising a particulate filter configured to remove particulates from the solvent based cleaning fluid pumped from the low mixing pump to the working tank.

6. The dry cleaning device according to claim 1, further comprising a fluid separator configured to receive the solvent based cleaning fluid from the working tank and substantially separate an aqueous phase from the solvent based cleaning fluid.

7. The dry cleaning device according to claim 6, further comprising a process pump configured to pump the solvent based cleaning fluid from the working tank to the fluid separator, wherein the process pump comprises a small positive displacement gear pump.

8. The dry cleaning device according to claim 6, further comprising an adsorption filter configured to remove impurities from the solvent based cleaning fluid generated from fluid separator.

9. The dry cleaning device according to claim 6, further comprising a clean storage tank configured to receive the solvent based cleaning fluid processed by the fluid separator.

10. The dry cleaning device according to claim 9, further comprising a purity sensor configured to monitor the purity of the solvent based cleaning fluid provided to the clean storage tank.

11. The dry cleaning device according to claim 1, wherein the solvent based cleaning fluid further comprises a cleaning agent selected from the group consisting of sanitizing agents, emulsifiers, surfactants, detergents, bleaches, softeners, and any combination thereof.

12. A dry cleaning device, comprising:

a washer drum;

a cleaning basket disposed in the washer drum and configured to receive articles and a solvent based cleaning fluid;

a working tank configured to receive the solvent based cleaning fluid used in the washer drum and cleaning basket;

an air management mechanism configured to drain cleaning fluid condensate produced from the washer drum and cleaning basket directly into the working tank;

a low mixing pump configured to pump the solvent based cleaning fluid from the cleaning basket to the working tank, the low mixing pump characterized by a Reynolds number of about 15,000 or less, wherein the Reynolds number is determined as a function of one or more properties associated with an impeller of the low mixing pump, and wherein the low mixing pump is coupled to the cleaning basket via an inlet line and is coupled to the air management mechanism via a cooling coil wash down tubing;

a fluid process pump configured to pump the solvent based cleaning fluid from the working tank; and a fluid separator configured to receive the solvent based cleaning fluid from the fluid process pump and substantially separate an aqueous phase from the solvent based cleaning fluid.

* * * * *